US008191492B2

(12) United States Patent
Hirose et al.

(10) Patent No.: US 8,191,492 B2
(45) Date of Patent: Jun. 5, 2012

(54) SEWING MACHINE AND COMPUTER-READABLE RECORDING MEDIUM STORING SEWING MACHINE CONTROL PROGRAM

(75) Inventors: Hirokazu Hirose, Chiryu (JP); Yoshinori Nakamura, Toyohashi (JP); Akie Ukai, Nagoya (JP); Masaki Shimizu, Toyoake (JP); Yoshio Nishimura, Nagoya (JP); Kazumi Sai, Nagoya (JP); Satoru Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1142 days.

(21) Appl. No.: 12/071,372

(22) Filed: Feb. 20, 2008

(65) Prior Publication Data

US 2008/0210147 A1 Sep. 4, 2008

(30) Foreign Application Priority Data

Mar. 1, 2007 (JP) ..... 2007-051839

(51) Int. Cl.
*D05B 19/00* (2006.01)

(52) U.S. Cl. ..... 112/470.03; 112/102.5; 112/470.01; 700/136

(58) Field of Classification Search ..... 112/102.5, 112/272, 470.01, 470.03, 470.06, 475.19; 700/136–138
See application file for complete search history.

(56) References Cited

U.S. PATENT DOCUMENTS

| | | | | |
|---|---|---|---|---|
| 5,410,976 | A * | 5/1995 | Matsubara | 112/102.5 |
| 6,263,815 | B1 * | 7/2001 | Furudate | 112/470.13 |
| 6,871,606 | B2 * | 3/2005 | Schweizer | 112/102.5 |
| 6,883,446 | B2 * | 4/2005 | Koerner | 112/272 |
| 6,994,042 | B2 * | 2/2006 | Schweizer | 112/470.03 |

FOREIGN PATENT DOCUMENTS

JP A-2002-292175 10/2002

* cited by examiner

*Primary Examiner* — Nathan Durham
(74) *Attorney, Agent, or Firm* — Oliff & Berridge, PLC

(57) ABSTRACT

A sewing machine that sews a work cloth being moved by a user includes a detection device that detects the work cloth, a movement calculation device that calculates movement data of the work cloth, a movement data storage device that stores the movement data, a movement data creation device that causes the detection device and the movement calculation device to respectively detect the work cloth and calculate the movement data for each stitch, and that stores the movement data into the movement data storage device, a line segment specification device that specifies a line segment based on the movement data, a determination device that determines whether a stitch to be formed next will overlap with an already formed stitch corresponding to the specified line segment, and an error control device that performs an error correction operation based on a determination result.

22 Claims, 21 Drawing Sheets

FIG. 11

632

| COORDINATE STORAGE AREA | | |
|---|---|---|
| NO. | X-COORDINATE | Y-COORDINATE |
| 0 | 0 | 0 |
| 1 | 20 | 0 |
| 2 | 39.9 | 1.7 |
| 3 | 58 | 10.2 |
| ⋮ | ⋮ | ⋮ |

RELATED ART

SEWING MACHINE AND COMPUTER-READABLE RECORDING MEDIUM STORING SEWING MACHINE CONTROL PROGRAM

CROSS-REFERENCE TO RELATED APPLICATION

This application claims priority to Japanese Patent Application No. 2007-051839, filed Mar. 1, 2007, the disclosure of which is hereby incorporated herein by reference in its entirety.

BACKGROUND

The present disclosure relates to a sewing machine and a computer-readable recording medium storing a sewing machine control program. More specifically, it relates to a sewing machine that can be used for free-motion sewing and a computer-readable recording medium storing a sewing machine control program for a sewing machine that can be used for free-motion sewing.

Quilting is a conventional sewing method. In quilting, a batting is sandwiched between an outer material and a lining material, and then those materials may be sewn up along a stitch pattern, such as a straight line or a curve. In quilting, there is a case where stitches are formed while a user is freely moving a work cloth manually. Such sewing is referred to as free-motion sewing. In free-motion sewing, stitches may look unattractive if their stitch lengths are not uniform. Therefore, it is desirable to form stitches with a uniform stitch length as much as possible. However, it is difficult for a beginner, who is not skilled in sewing operations, to sew up a work cloth in such a manner as to form stitches with a substantially uniform stitch length while moving the work cloth in a desired direction. To solve this problem, a technique is disclosed in Japanese Patent Application Laid-Open Publication No. 2002-292175 in which driving of a sewing machine is controlled in such a manner as to form stitches with a uniform stitch length by obtaining a movement distance of a work cloth for each stitch, so that the sewing speed may be changed in accordance with the obtained movement distance.

In some cases, a stippling stitch is used in free-motion sewing. A stippling stitch should be disposed evenly within a predetermined region so that a user may enjoy the resulting beautiful design (see FIG. 21). In the stippling stitch, a uniform stitch length is not sufficient to obtain a beautiful result. Like stitch 902 in a predetermined region 901 shown in FIG. 21, a beautiful stippling stitch should create a smooth curve that is disposed within the region 901 in a well-balanced and even manner. The stitch line should not overlap itself, nor should it come too close to other parts of the stitch line.

In a case where a user unskilled in the sewing operation sews the stippling stitch in the course of free-motion sewing with a sewing machine that employs the aforementioned conventional technique, the user can perform sewing in such a manner as to form stitches with a uniform stitch length. However, the user may still find it difficult to perform sewing while taking care not to form a stitch line with an overlapping part, and may even fail to do so. In such a case, the user may be involved in a troublesome task, because he must stop sewing, cut off a thread, remove the failed stitches, and then restart sewing.

SUMMARY

Various exemplary embodiments of the general principles described herein provide a sewing machine and sewing machine control program recorded in a computer-readable recording medium that detects a likelihood of stitches overlapping with each other in free motion sewing in which a user performs sewing as he/she manually moves a piece of work cloth.

Exemplary embodiments provide a sewing machine that sews a work cloth being moved by a user. The sewing machine includes a detection device that detects the work cloth, a movement calculation device that calculates a direction and a distance of movement of the work cloth as movement data when the work cloth is detected by the detection device, the movement being determined based on the location where the work cloth was previously detected by the detection device, and the movement data being in the form of two-dimensional coordinate data, a movement data storage device that stores the movement data calculated by the movement calculation device, a movement data creation device that causes the detection device to detect the work cloth for each stitch formed in sewing the work cloth, thereby causing the movement calculation device to calculate the movement data, and that stores the movement data calculated by the movement calculation device into the movement data storage device, a line segment specification device that specifies a line segment as a specified line segment based on the movement data stored in the movement data storage device, a determination device that determines whether a stitch to be formed next may overlap with an already formed stitch when the work cloth is detected by the detection device in a state where a sewing needle is above the work cloth, based on whether a line segment interconnecting a first position and a second position overlaps with the specified line segment or whether the specified line segment exists within a predetermined distance from the first position or the second position, the first position being a position on the work cloth below the sewing needle, and the second position being a most recent needle drop position, and an error control device that performs an error correction operation if it is determined by the determination device that the stitch to be formed next may overlap with the already formed stitch.

Exemplary embodiments also provide a sewing machine that sews a work cloth being moved by a user, the sewing machine including a detection device that detects a stitch formed on the work cloth, a determination device that determines whether a stitch to be formed next will overlap with an already formed stitch, based on whether the stitch detected by the detection device exists within a predetermined range determined on the basis of a first position or whether a line segment interconnecting the first position and a second position overlaps with the stitch detected by the detection device, the first position being a position on the work cloth below a sewing needle when the stitch, is detected by the detection device in a state where the sewing needle is above the work cloth, the second position being a most recent needle drop position, and an error control device that performs an error correction operation if it is determined by the determination device that the stitch to be formed next will overlap with the already formed stitch.

Exemplary embodiments further provide a computer-readable recording medium storing a sewing machine control program for a sewing machine that sews a work cloth being moved by a user. The program includes instructions for detecting the work cloth, instructions for calculating a direction and a distance of movement of the work cloth as calculated movement data each time the work cloth is detected, the movement being determined based on a location where the work cloth was previously detected, and the movement data being in the form of two-dimensional coordinate data, instructions for storing the calculated movement data as stored movement data each time the movement data is calculated, instructions for specifying a line segment as a specified line segment based on the stored movement data, instructions for determining whether a stitch to be formed next will overlap with an already formed stitch when the work cloth is detected in a state where a sewing needle is above the work cloth, based on whether a line segment interconnecting a first position and a second position overlaps with the specified line segment or whether the specified line segment exists within a predetermined distance from the first position or the second position, the first position being a position on the work cloth below the sewing needle, and the second position being a most recent needle drop position, and instructions for performing an error correction operation if it is determined that the stitch that is to be formed next will overlap with the already formed stitch.

Exemplary embodiments further provide a computer-readable recording medium storing a sewing machine control program for a sewing machine that sews a work cloth being moved by a user, the program including instructions for detecting a stitch formed on the work cloth, instructions for determining whether a stitch to be formed next will overlap with an already formed stitch, based on whether the detected stitch exists within a predetermined range determined on the basis of a first position or whether a line segment interconnecting the first position and a second position overlaps with the detected stitch, the first position being a position on the work cloth below a sewing needle when the stitch is detected in a state where the sewing needle is above the work cloth, the second position being a most recent needle drop position, and instructions for performing an error correction operation if it is determined that the stitch to be formed next will overlap with the already formed stitch.

BRIEF DESCRIPTION OF THE DRAWINGS

Exemplary embodiments of the present disclosure will be described below in detail with reference to the accompanying drawings in which:

FIG. 11 is a table showing the configuration of a coordinate storage area in the RAM;

DETAILED DESCRIPTION

The following describes first and second embodiments of the present disclosure with reference to the drawings. First, the first embodiment is described below with reference to FIGS. 1-15. The configuration of a sewing machine I in the first embodiment is described below with reference to FIGS. 1-11.

Figure 1:
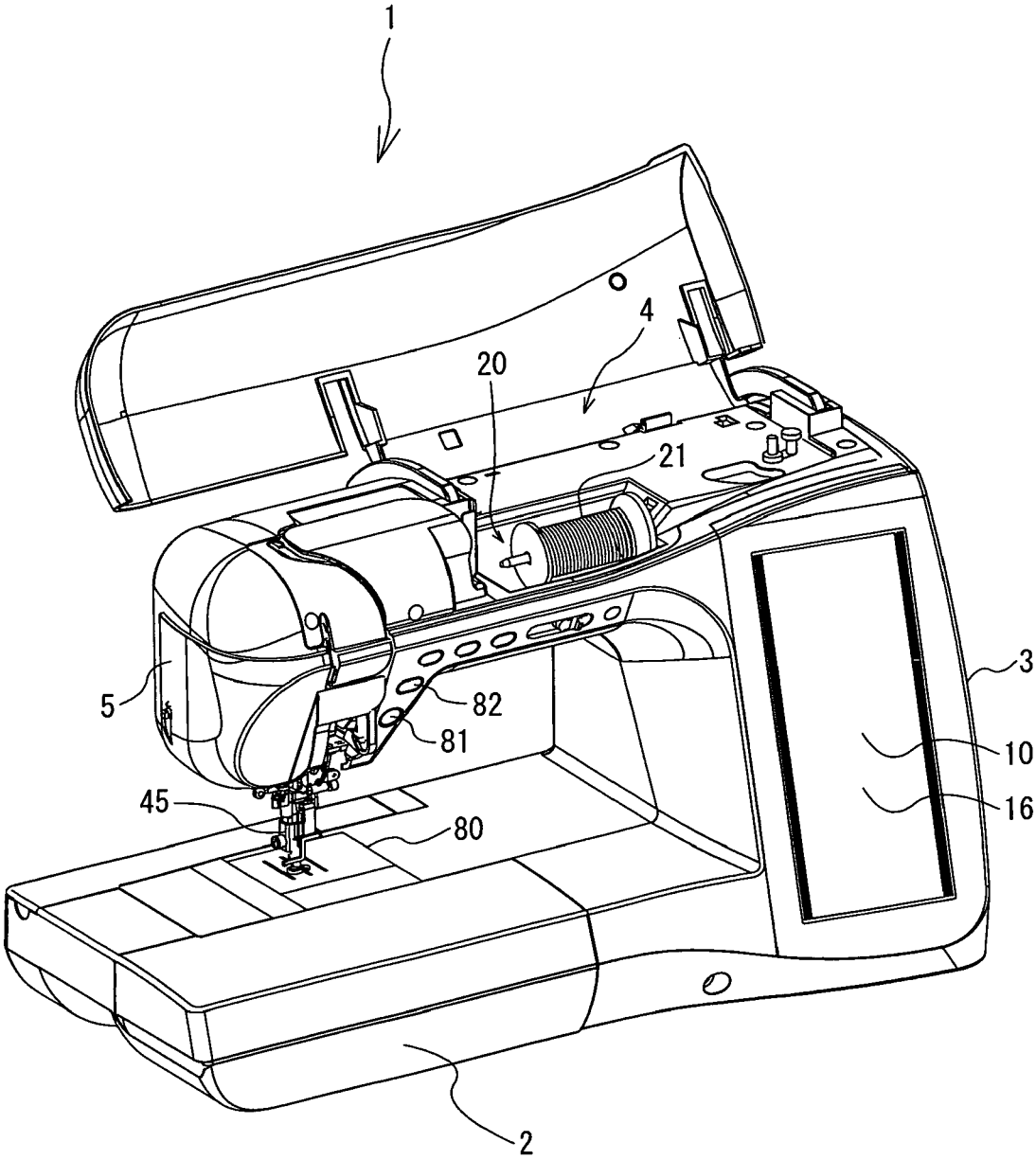
FIG. 1 is an overall perspective view of a sewing machine according to a first embodiment.

The physical configuration of the sewing machine 1 in the present embodiment will be described below with reference to FIG. 1. The sewing machine I has a sewing machine bed 2 that extends in the right and left directions, a pillar 3 that is erected upward at the right end of the sewing machine bed 2, and an arm 4 that extends leftward from the upper end of the pillar 3. The left end of the arm 4 is referred to as a head portion 5. The pillar 3 has on a front surface thereof a liquid crystal display (LCD) 10 having a touch panel 16 on its surface. The LCD 10 displays entry keys and the like for entering a pattern to be sewn, sewing conditions, etc. The user can select a desired pattern to be sewn, desired sewing conditions and the like by touching the positions corresponding to those entry keys on the touch panel 16. The sewing machine 1 includes a sewing machine motor 79 (see FIG. 9), a drive shaft 11 (see FIG. 2), a needle bar 6 (see FIG. 3), a needle bar up-and-down movement mechanism 22 (see FIG. 2), a needle bar swinging mechanism 26 (see FIG. 3), and a needle bar releasing mechanism 25 (see FIG. 3). A sewing needle 7 (see FIG. 2) is attached to the lower end of the needle bar 6. The needle bar up-and-down movement mechanism 22 is configured to raise and lower the needle bar 6. The needle bar swinging mechanism 26 is configured to swing the needle bar 6 in the right and left direction. The needle bar releasing mechanism 25 is configured to release the needle bar 6 from the driving force of the sewing machine motor 79.

The sewing machine bed 2 has a needle plate 80 disposed on an upper surface thereof. The sewing machine bed 2 includes a feed dog back-and-forth movement mechanism (not shown), a feed dog up-and-down movement mechanism (not shown), a feed adjustment pulse motor 78 (see FIG. 9), and a shuttle mechanism (not shown). The feed dog back-and-forth movement mechanism and the feed dog up-and-down movement mechanism are configured to drive a feed dog (not shown). The feed adjustment pulse motor 78 adjusts a feed distance by which a work cloth is fed by the feed dog. The shuttle mechanism houses a bobbin with a wound bobbin thread.

The head portion 5 has on a front surface thereof a sewing start switch 81 and a sewing stop switch 82. The sewing start switch 81 is used to start sewing by starting the drive of the sewing machine motor 79. The sewing stop switch 82 is used to stop sewing by stopping the driving of the sewing machine motor 79. The sewing machine 1 has on a right side surface thereof a pulley (not shown) with which the drive shaft 11 is rotated by hand to move the needle bar up and down.

Figure 2:
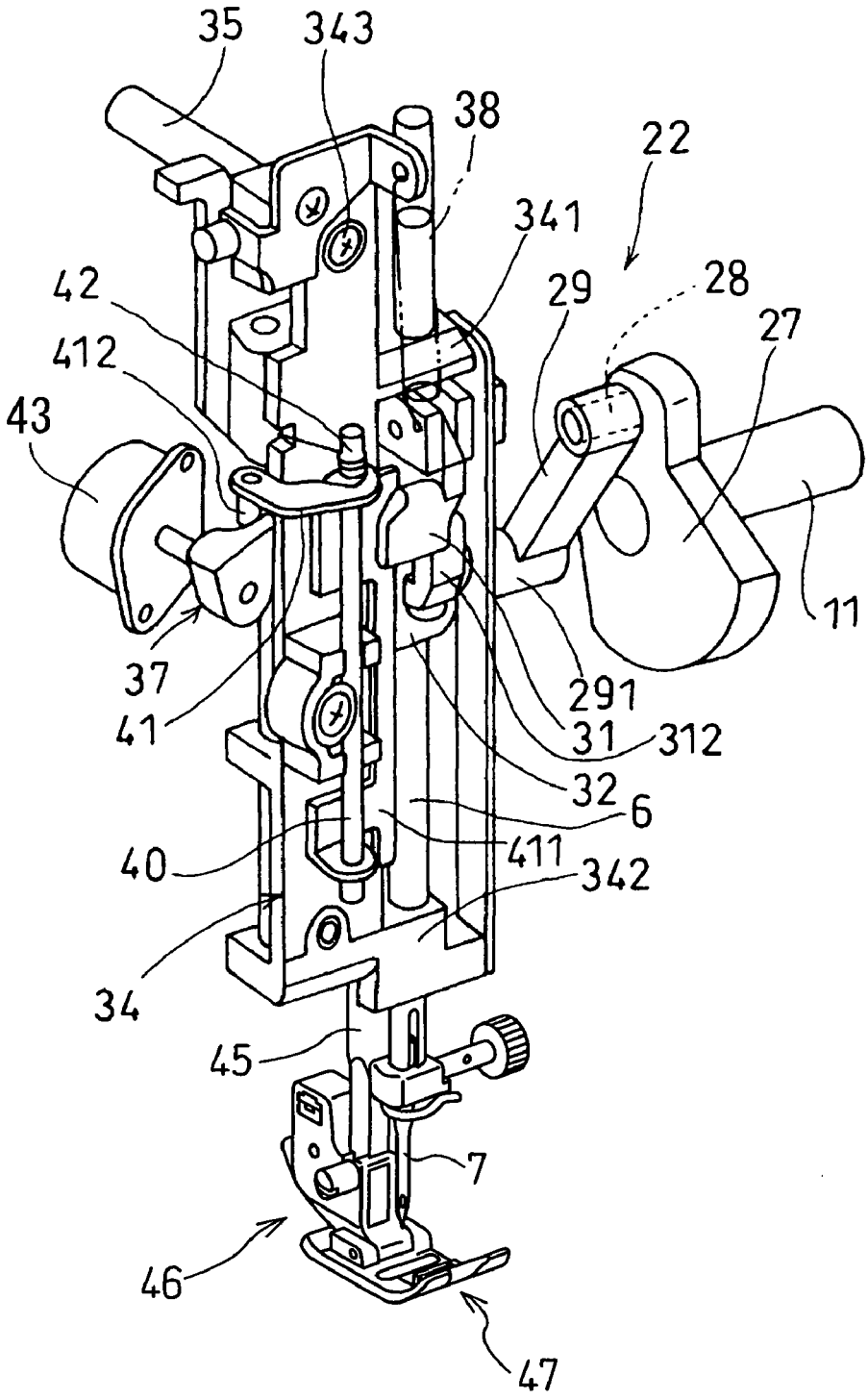
FIG. 2 is a perspective view showing a needle bar up-and-down movement mechanism and a needle bar releasing mechanism in the sewing machine of FIG. 1.
Figure 3:
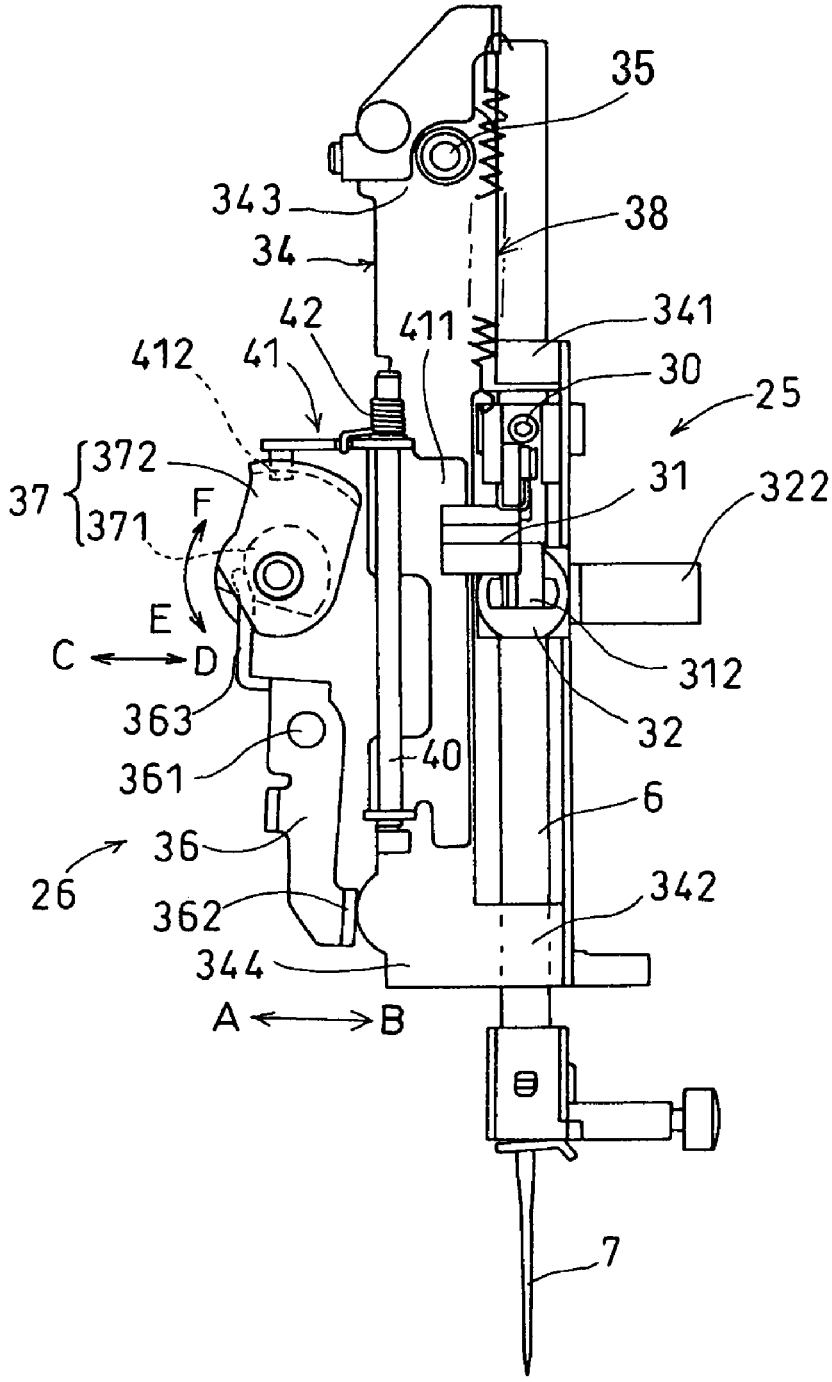
FIG. 3 is an elevational view of major components showing the needle bar up-and-down movement mechanism and the needle bar releasing mechanism in the sewing machine of FIG. 1.
Figure 4:
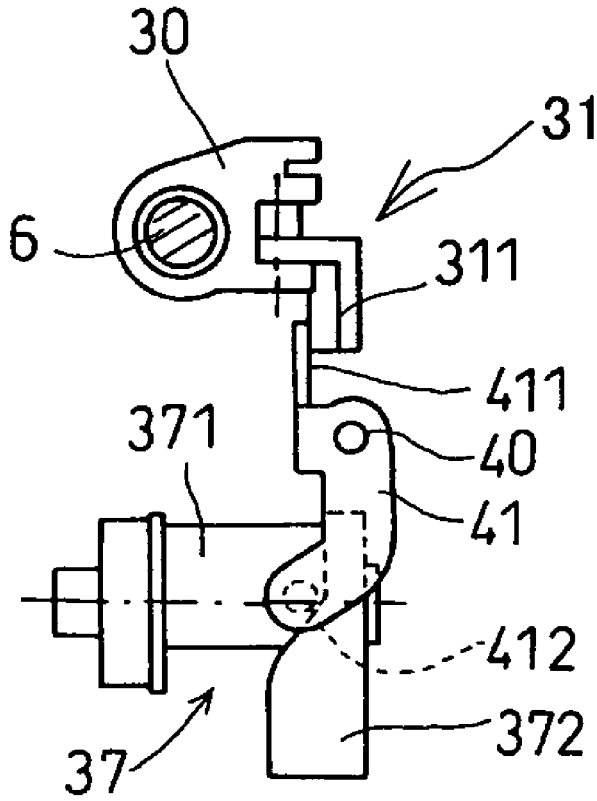
FIG. 4 is an explanatory illustration showing an operation of the needle bar releasing mechanism to release a needle bar.

Next, the needle bar up-and-down movement mechanism 22 will be described below with reference to FIGS. 2-7. As shown in FIGS. 2 and 3, the needle bar 6 is slidably supported by an upper support portion 341 and a lower support portion 342 of a needle bar support 34 in such a manner that the needle bar 6 can move up and down. At a position along the needle bar 6, a needle bar pawl support 30 (see FIG. 3) is fixed. The base end (upper end) of a needle bar pawl body 31 is pivotally supported by a pin 301 (see FIG. 6) in such a manner that the needle bar pawl body 31 is pivotally movable (see FIGS. 6 and 7). Below the needle bar pawl support 30, a needle bar guide bracket 32 is connected to the needle bar 6 in such a manner that the needle bar guide bracket 32 can move up and down with respect to the needle bar 6.

Figure 6:
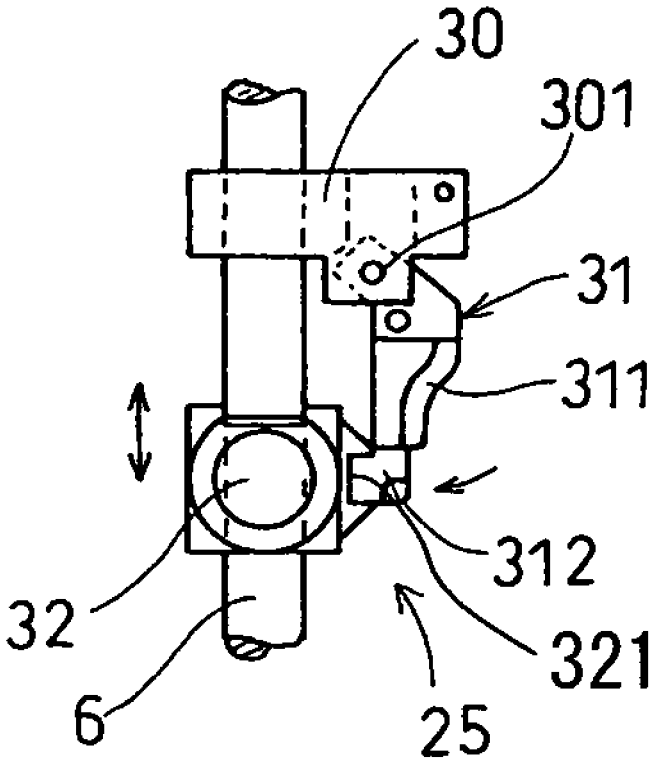
FIG. 6 is an explanatory illustration showing a further operation of the needle bar releasing mechanism to release a needle bar.

A thread take-up crank 27 is fitted to the end of the drive shaft 11, and a needle bar crank rod 29 is coupled via a crank pin 28 which projects laterally from the thread take-up crank 27. A boss 291 of the needle bar crank rod 29 and a shaft 322 which protrudes from the needle bar guide bracket 32, are coupled in such a manner that the boss 291 can be rotated with respect to the shaft 322. As shown in FIG. 6, an engagement pawl portion 312 formed at the end (lower end) of the needle bar pawl body 31 can be engaged with and disengaged from a concaved locking portion 321 formed in the needle bar guide bracket 32. Further, a torsion spring (not shown) is connected to the base end of the needle bar pawl body 31, so that its spring force acts to hold the engagement pawl portion 312 and the locking portion 321 in an engaged state. If the drive shaft 11 is rotated by the driving of the sewing machine motor 79 while the engagement pawl portion 312 is engaged with the locking portion 321 as shown in FIG. 6, the rotation of the drive shaft 11 is transmitted as up-and-down movement to the needle bar guide bracket 32 via the thread take-up crank 27 and the needle bar crank rod 29. The up-and-down movement of the needle bar guide bracket 32 is transmitted via the needle bar pawl body 31 and the needle bar pawl support 30 to move the needle bar 6 up and down. A thread take-up lever (not shown) coupled to the thread take-up crank 27 moves up and down in conjunction with the rotation of the drive shaft 11.

The needle bar swinging mechanism 26 is described below. The needle bar support 34 is hung and supported at its upper end 343 by a support shaft 35 that is fixed to a frame (not shown) of the sewing machine 1 so that the needle bar support 34 can be moved rotationally. Further, the lower end of the needle bar support 34 is urged in an arrow A direction by a spring (not shown). As shown in FIG. 3, the needle bar swinging lever 36 (not shown in FIG. 2) is axially supported by a support shaft 361 that is fixed to the frame of the sewing machine 1. The lower end of 362 of the needle bar swinging lever 36 is in contact with the side surface of the lower end 344 of the needle bar support 34.

As shown in FIG. 2, a needle bar swinging-and-releasing pulse motor 43 (hereinafter simply referred to as pulse motor 43) is fixed to the frame of the sewing machine 1. A cam body 37, which includes a needle bar swinging cam portion 371 and a needle bar releasing cam portion 372, is fixed to the rotary shaft of the pulse motor 43 in such a manner as to rotate integrally with the rotary shaft. As shown in FIG. 3, the needle bar swinging cam portion 371 of the cam body 37 contacts a contacting portion 363 connected at the upper end of the needle bar swinging lever 36. When the pulse motor 43 operates to rotate the needle bar swinging cam portion 371 in an arrow E direction, the contacting portion 363 of the needle bar swinging lever 36 is pressed by the needle bar swinging cam portion 371 and moved rotationally in an arrow C direction. As a result, the lower end 344 of the needle bar support 34 is pressed in an arrow B direction against the biasing force of the spring. Conversely, when the needle bar swinging cam portion 371 is rotated in an arrow F direction in FIG. 3, the lower end 344 of the needle bar support 34 is moved in an arrow A direction.

Next, the configuration of the needle bar releasing mechanism 25 is described below. As shown in FIGS. 2 and 3, a support shaft 40 and the needle bar 6 are supported on the needle bar support 34, in parallel. A releasing lever 41 is supported by the support shaft 40 so that the releasing lever 41 can be moved rotationally. A flared portion 411 formed at one end of the releasing lever 41 can contact an overhang portion 311 of the needle bar pawl body 31 (see FIG. 4). Further, a pin-like cam follower 412 that protrudes downward from the other end of the releasing lever 41 can contact the needle bar releasing cam portion 372 of the cam body 37 (see FIG. 4).

A coil portion of a torsion coil spring 42 is supported around the support shaft 40. A fixing end extending from the coil portion of the torsion coil spring 42 is fixed to the flared portion 411 of the releasing lever 41 to urge the releasing lever 41 in a direction in which the cam follower 412 can contact with the needle bar releasing cam portion 372. Therefore, when the cam body 37 is rotated by the pulse motor 43, the needle bar releasing cam portion 372 contacts the cam follower 412 so that the releasing lever 41 may be moved clockwise around the support shaft 40 against the biasing force of the torsion coil spring 42 (see FIGS. 4 and 5). Therefore, the flared portion 411 presses the overhang portion 311 of the needle bar pawl body 31 in the right-hand direction in FIGS. 4 and 5. Consequently, the needle bar pawl body 31 is pivotally moved in a direction in which the engagement pawl portion 312 is disengaged from the locking portion 321 of the needle bar guide bracket 32 (see FIGS. 6 and 7). As such, the needle bar pawl support 30 and the needle bar guide bracket 32 are released from a state (engaged state) where they are coupled in a driving relation to each other. The flared portion 411 of the releasing lever 41 extends over a range within which the needle bar pawl body 31 moves up and down when the needle bar pawl body 31 is engaged with the needle bar guide bracket 32. It is thus possible to release the needle bar 6 irrespective of the vertical position of the needle bar 6.

Figure 7:
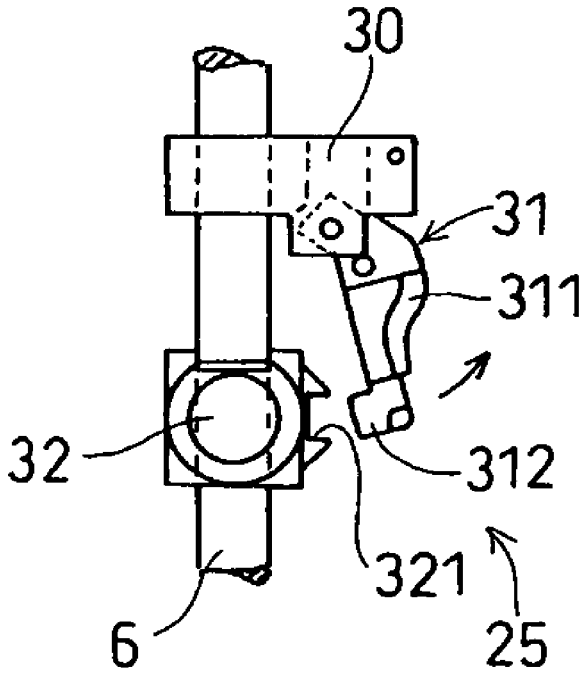
FIG. 7 is an explanatory illustration showing an additional operation of the needle bar releasing mechanism to release a needle bar.

Between the needle bar pawl support 30 and the upper end of the needle bar support 34, a tension spring 38 is disposed to constantly urge the needle bar 6 upward. The tension spring 38 pulls the needle bar 6 up to a top dead center position if the needle bar pawl support 30 and the needle bar guide bracket 32 are released from the state in which they are coupled in a driving relation to each other, as shown in FIG. 7. Thus, the needle bar 6 stays in a standby state at the top dead center position when the needle bar 6 is released.

On the other hand, if the cam follower 412 is separated from the needle bar releasing cam portion 372 by driving of the pulse motor 43, the biasing force of the torsion coil spring 42 causes the flared portion 411 of the releasing lever 41 to move rotationally in such a direction as to be separated from the overhang portion 311 of the needle bar pawl body 31. Accordingly, by a torsion spring (not shown), the engagement pawl portion 312 of the needle bar pawl body 31 is locked to the locking portion 321 of the needle bar guide bracket 32, as shown in FIG. 6. As a result, the engagement pawl portion 312 and the locking portion 321 are coupled in a driving relation to each other. This coupling operation is performed at the top dead center position of the needle bar 6.

As described above, the needle bar releasing mechanism 25 and the needle bar swinging mechanism 26 are configured to be operated by the driving of the pulse motor 43. The operations to release and swing the needle bar 6 can be controlled by causing a later-described CPU 61 to execute a program.

Figure 8:
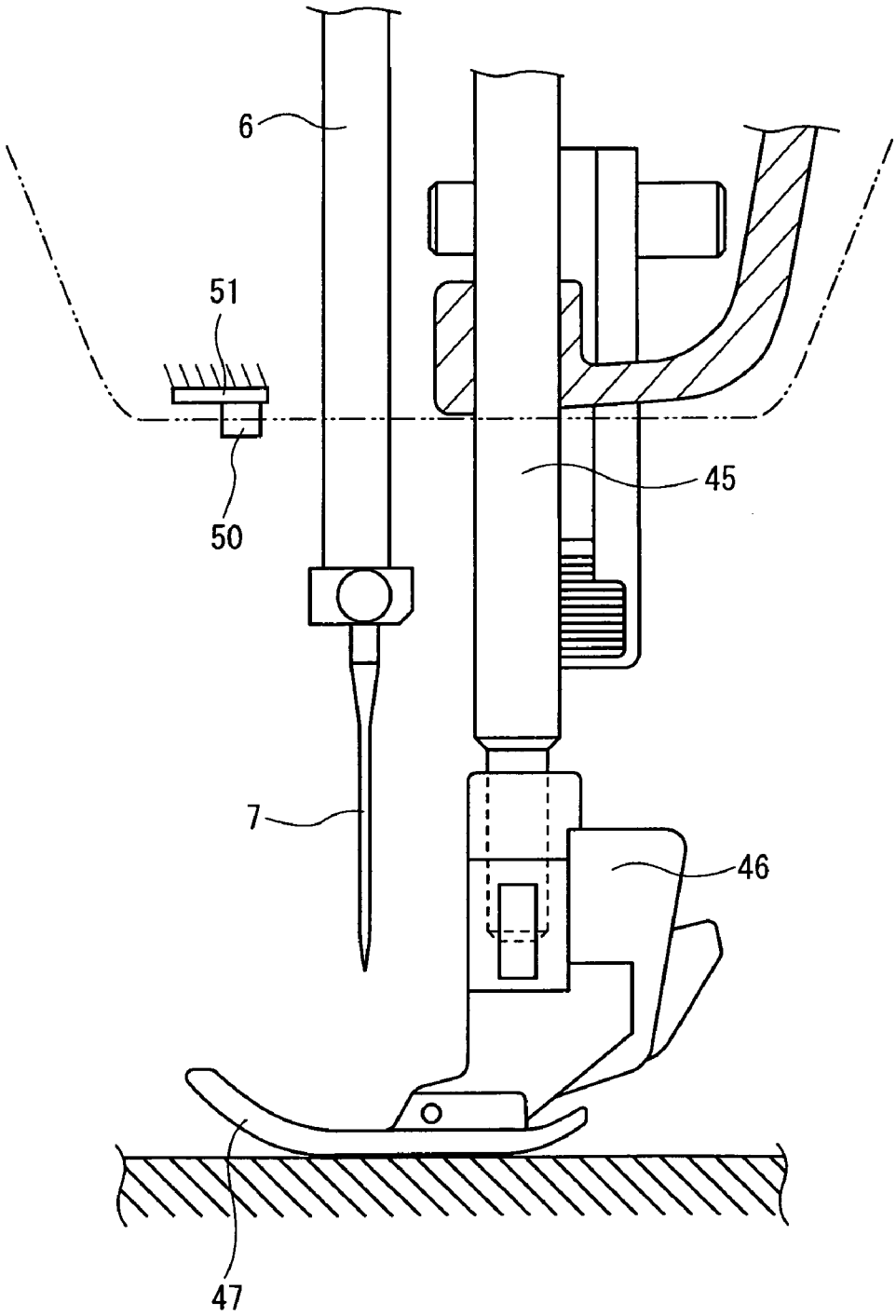
FIG. 8 is a side view of major components showing a sewing needle, a presser foot, and an image sensor.

Next, an image sensor 50 disposed in the sewing machine 1 will be described below with reference to FIG. 8. The image sensor 50 includes a CCD camera and a control circuit, and captures an image with the CCD camera at predetermined lapses of time. The control circuit compares the most recently taken image and a currently taken image to pick up a portion commonly included in both images, and then provides values that represent a direction and a distance of the movement of the target based on a range of the commonly included portion and its position in the images. In the present embodiment, as shown in FIG. 8, a frame (not shown) of the sewing machine 1 is fitted with a support frame 51. The image sensor 50 is attached to the support frame 51 at a position where the image sensor 50 can capture an image of an area including a needle drop point of the sewing needle 7 and its vicinity. The needle drop point herein refers to a point at which a work cloth is stuck through by the sewing needle 7 attached to the needle bar 6 when the needle bar 6 is moved downward by the needle bar up-and-down movement mechanism 22 (see FIG. 1). A presser foot 47, which holds down the work cloth, is attached to a presser holder 46, which is fixed to the lower end of a presser bar 45. The presser foot 47 and the presser holder 46 are made of a transparent resin so that images of stitches can be taken through them.

Figure 9:
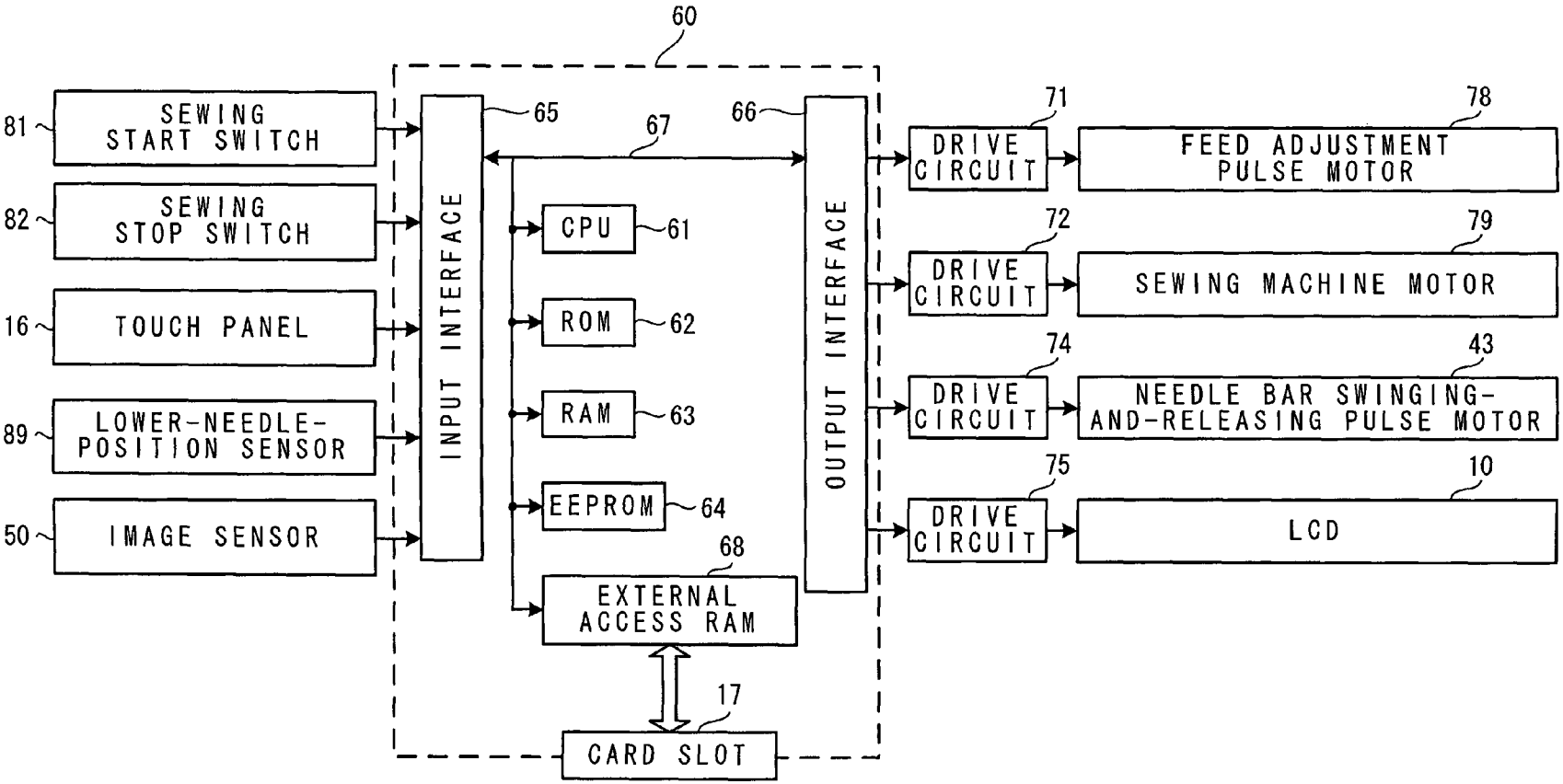
FIG. 9 is a block diagram showing an electrical configuration of the sewing machine.

Next, the electrical configuration of the sewing machine 1 is described below with reference to FIG. 9. As shown in FIG. 9, a body 60 of the sewing machine 1 includes a CPU 61, a ROM 62, a RAM 63, an EEPROM 64, a card slot 17, an external access RAM 68, an input interface 65 and an output interface 66 which are connected to each other by a bus 67. A sewing start switch 81, a sewing stop switch 82, a touch panel 16, a lower-needle-position sensor 89, and the image sensor 50 are connected to the input interface 65. Drive circuits 71, 72, 74 and 75 are connected to the output interface 66. The drive circuit 71 drives the feed adjustment pulse motor 78. The drive circuit 72 drives the sewing machine motor 79, which is used to rotate the drive shaft 11. The drive circuit 74 drives the pulse motor 43, which is used to swing or release the needle bar 6. The drive circuit 75 drives the LCD 10.

The CPU 61 conducts main control over the sewing machine 1, to perform a variety of computations and processing in accordance with a control program stored in a control program storage area of the ROM 62, which is a read only memory device. The RAM 63, which is a random access memory, is provided with various storage areas as required for storing the results of various computations by the CPU 61. The sewing start switch 81 and the sewing stop switch 82 are button type switches. The lower-needle-position sensor 89, which detects a rotation phase of the drive shaft 11, is configured to output an ON signal when the needle bar 6 is lowered from a higher needle position down to a lower needle position as the drive shaft 11 revolves. The higher needle position herein refers to a position at which the tip of the sewing needle 7 is above the upper surface of the needle plate 80, i.e., above the work cloth. The lower needle position herein refers to a position where the tip of the sewing needle 7 is below the upper surface of the needle plate 80.

Figure 10:
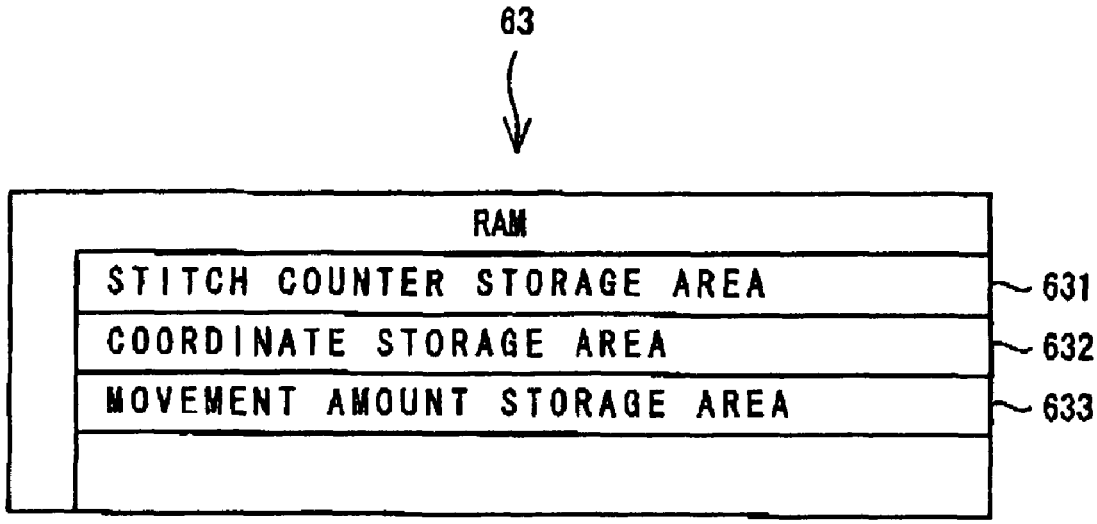
FIG. 10 is a conceptual diagram showing storage areas provided in RAM.

Next, storage areas in the RAM 63 are described below with reference to FIG. 10. As shown in FIG. 10, the RAM 63 has a stitch counter storage area 631, a coordinate storage area 632, and a movement amount storage area 633. The RAM 63 also has additional storage areas other than those illustrated. The stitch counter storage area 631 stores a stitch counter that counts the number of stitches when the coordinates of a stitch are recorded. The coordinate storage area 632 stores the coordinates of a stitch. The movement amount storage area 633 stores a movement amount of a work cloth that is outputted by the image sensor 50.

Next, the coordinate storage area 632 in the RAM 63 will be described below with reference to FIG. 11. The coordinate storage area 632 stores coordinates array R, which is a two-dimensional array showing a trajectory-of stitches. The coordinates array R includes an x-coordinate and a y-coordinate. The subscript of the two-dimensional array begins with "0". The n'th array is herein expressed as $R_n$ ($X_n$, $Y_n$). This means that the n'th array has an x-coordinate of $X_n$ and a y-coordinate of $Y_n$. Further, a point represented by the coordinates in the array $R_n$ is herein expressed as $p_n$. In the 0'th array, a position of the work cloth before the start of sewing, i.e., (0, 0), is stored as a reference position. The first and subsequent arrays sequentially store the coordinates that represent the positions of needle drop points with respect to the reference position. Thus, the n'th array stores the coordinates of the n'th needle drop point.

Next, the operations of the sewing machine 1 will be described below with reference to FIG. 12. Processing in FIG. 12 starts when the startup of sewing is instructed by the operation of the sewing start switch 81. In this processing, position information of stitches is recorded as coordinate information. Then, it is continually monitored whether a stitch to be formed overlaps with an already formed stitch when the sewing needle 7 is at the higher needle position and is to be lowered down to form the stitch on a work cloth. If having determined that the'stitches would overlap, the needle bar 6 is released from the power of the sewing machine motor 79 (needle bar releasing) so that the sewing needle 7 does not operate, thus controlling the sewing machine 1 not to form stitches.

First, in step 1 (S1) an initial value of 0 is stored in the stitch counter storage area 631 of the RAM 63 to initialize a stitch counter n. Then, in step 2 (S2) the CPU 61 accesses the image sensor 50. When accessed, the image sensor 50 captures an image at startup which serves as a reference. In step 3 (S3) initial values for the coordinates array $R_n$, i.e., ($X_0$=0, $Y_0$=0), are stored into the coordinates array $R_0$. In step 4 (S4) the sewing machine motor 79 starts revolving.

In step 5 (S5) a determination is made as to whether the output of the lower-needle-position sensor 89 is an ON signal, which indicates that the sewing needle 7 is at the lower needle position. When the sewing needle 7 is at the lower needle position (YES at S5), the sewing needle 7 pierces the work cloth so that the work cloth cannot be moved. Therefore, it is not necessary to detect a movement amount of the work cloth. Therefore, the determination is repeated at S5 until the lower-needle-position sensor 89 outputs an OFF signal, which indicates that the sewing needle 7 is not at the lower needle position (NO at S5).

When the lower-needle-position sensor 89 outputs an OFF signal to indicate that the sewing needle 7 is not at the lower needle position (NO at S5), it means that the sewing needle 7 has been pulled out of the work cloth, and thus the work cloth can be moved. Therefore, a position at which the lowered sewing needle 7 is to pierce the work cloth next time becomes the ending point of the next stitch. The stitch counter n is incremented by "1" (S6). More specifically, 1 is added to the initial value 0 so that the stitch counter n becomes 1. Then, in step 7 (S7) coordinate values of the coordinates array $R_{n-1}$ are stored in the coordinates array $R_n$. More specifically, the values of $R_0$ (0, 0) are stored in $R_1$.

In step 8 (S8) a determination is made as to whether the output of the lower-needle-position sensor 89 is an ON signal, which indicates that the sewing needle 7 is at the lower needle position (S8). When the output of the lower-needle-position sensor 89 is an OFF signal, which indicates that the sewing needle 7 is not at the lower needle position (NO at S8), it means that the sewing needle 7 is not pierced into the work cloth, so the work cloth is still moving. Therefore, in step 9 (S9) the CPU 11 accesses the image sensor 50 to acquire an amount of movement as measured from a position at the time of the previous access and stores the amount in the movement amount storage area 633. The movement amounts in the x-direction and the y-direction acquired from the image sensor 50 are written as the X and Y coordinates, respectively. The movement amount acquired from the image sensor 50 is added to $R_n$, and $R_n$ is updated in step 10 (S10). Specifically, $X_n=X_n+X$ and $Y_n=Y_n+Y$ are obtained. The updated $R_n$ represents the current position of the sewing needle 7.

In step 11 (S11) a determination is made as to whether a stitch to be formed by interconnecting a point represented by $R_n$ and a point represented by $R_{n-1}$ overlaps with any one of the stitches formed so far if the sewing needle 7 is currently pierced into the piece of work cloth. More specifically, determination is made as to whether a line segment $P_{n-1}p_n$, which interconnects points $p_{n-1}$ and $p_n$, overlaps with any one of line segments $p_0p_1$, $p_1p_2$, . . . , and $p_{n-2}p_{n-1}$. The determination processing at S11 will be described in detail later with reference to a flowchart in FIG. 15. Then in step 12 (S12) a determination is made as to whether it was determined that the stitches overlap with each other in the determination processing at S11. In this case, because n=1 and thus no stitch has been formed, there is no stitch to be compared. Consequently, it has been determined that there are no overlapping stitches in the determination processing at S11 (NO at S12). Thus, the process returns to S8.

When the output of the lower-needle-position sensor 89 is obtained as an ON signal, indicating that the sewing needle 7 is at the lower needle position through the repetitive performance of the processing of S8-S12 (YES at S8), the repetition of the processing of S8-S12 is stopped and the process advances to step 13 (S13). In other words, the updating of the coordinates array $R_n$ is ended when the sewing needle 7 is pierced into the work cloth and positioned at the lower needle position. Accordingly, the coordinates immediately before the sewing needle 7 is pierced into the work cloth are employed as the values of the coordinates array $R_n$. Because the processing of S8-S12 are continually repeated by the CPU 61, there is no problem to employ those coordinates as those of a needle drop point when making determination of a stitch overlap.

At S13, a determination is made as to whether the sewing stop switch 82is operated (S 13). If the sewing stop switch 82 is not operated (NO at S 13), the process returns to S5 to wait until the sewing needle 7 is again moved from the lower needle position (YES at S5). If an OFF signal is obtained as the output of the lower-needle-position sensor 89, indicating that the sewing needle 7 is moved from the lower needle position (NO at S5), the stitch counter n is incremented by 1 to provide a count of 2 (S6). Then, the values of the coordinates array $R_{n-1}$ are stored into the coordinates array $R_n$ (S7). More specifically, the values of $R_1$ are stored in $R_2$. The process then advances to S8. In such a manner, the processing of S5-S13 is repeated.

Figure 5:
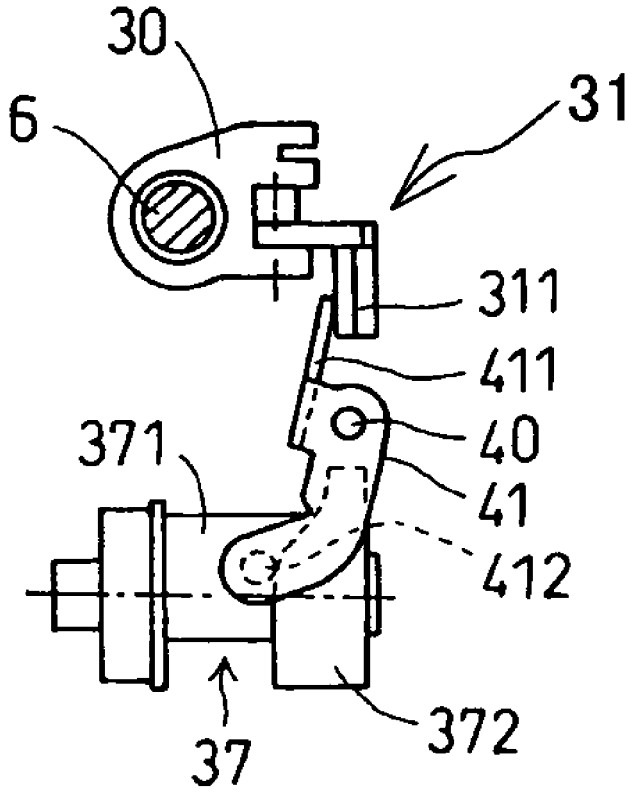
FIG. 5 is an explanatory illustration showing another operation of the needle bar releasing mechanism to release a needle bar.

When the processing of S5-S12 is repeated and it is determined that the line segment $p_{n-1}p_n$ that interconnects points $p_{n-1}$ and $p_n$ overlaps with any one of line segments $p_0p_1$, $p_1p_2$, . . . , and $p_{n-2}p_{n-1}$, that is, the stitches overlap if the sewing needle 7 is lowered from the current position to form a stitch (YES at S12), an error correction operation is performed. In the error correction operation, at step 14 (S14) the needle bar releasing mechanism 25 is operated to release the needle bar 6 from the power of the sewing machine motor 79. More specifically, the pulse motor 43 is driven to rotate the cam body 37. When the cam body 37 is rotated to be in a state as shown in FIG. 5, the needle bar releasing cam portion 372 presses the cam follower 412. Consequently, the releasing lever 41 moves clockwise as shown in FIG. 5 against the biasing force of the torsion coil spring 42. As a result, the flared portion 411 of the releasing lever 41 pivotally moves the overhang portion 311 of the needle bar pawl body 31 upward to release the needle bar pawl support 30 and the needle bar guide bracket 32 from the state in which they are coupled in driving relation to each other. After the needle bar 6 is released, the sewing machine motor 79 is stopped in step 15 (S 15) and the processing ends. If the sewing stop switch 82 is operated (YES at S 13), the sewing machine motor 79 is stopped (S15) and the processing is ended.

Figure 13:
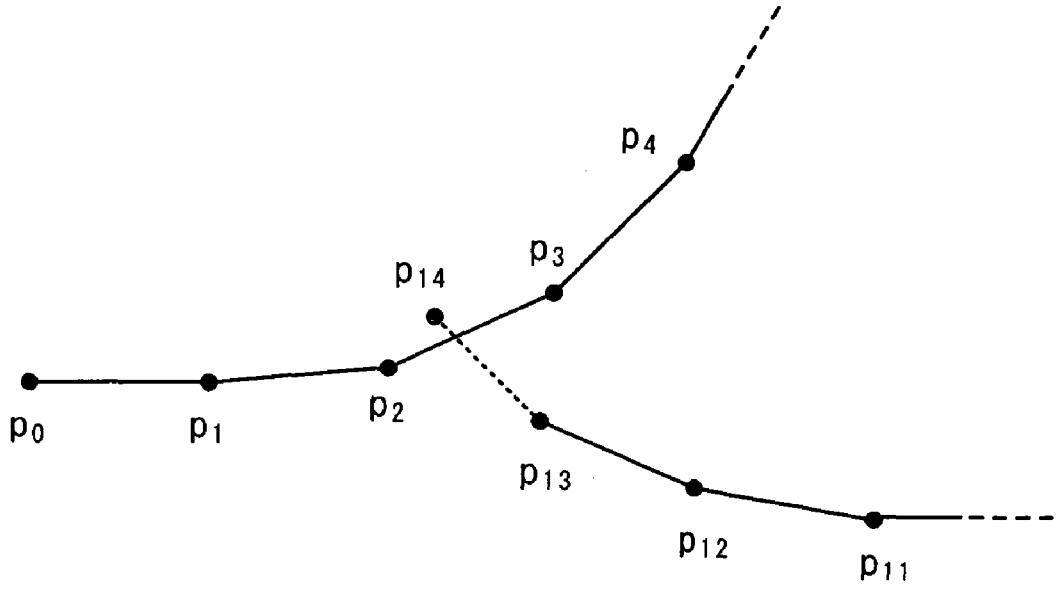
FIG. 13 is an explanatory illustration showing a situation where a new stitch intersects with an already formed stitch.
Figure 14:
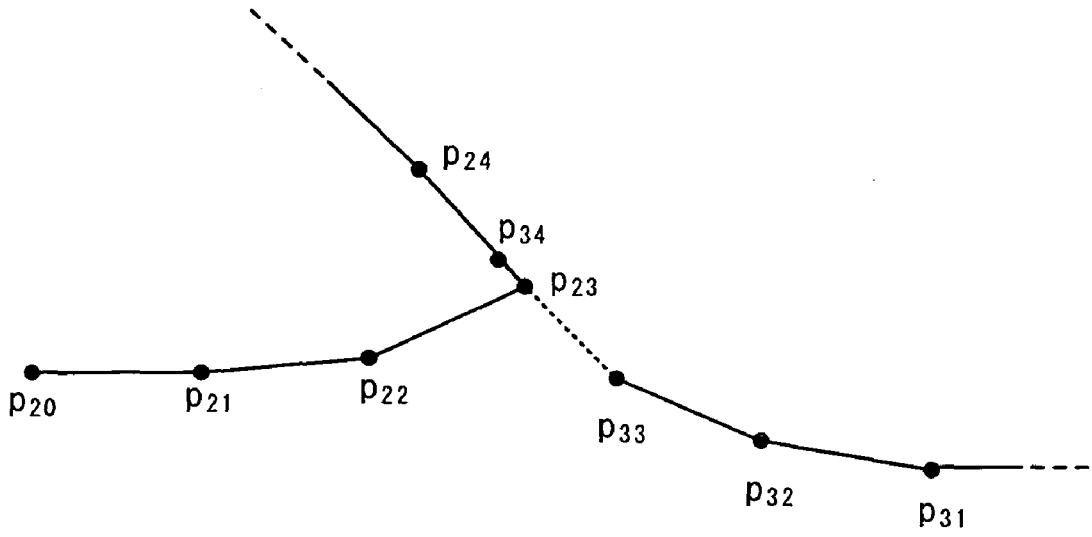
FIG. 14 is an explanatory illustration showing a situation where a new stitch is formed on an already formed stitch.

Now, determination processing on the stitch overlap at S11 is described below with reference to FIGS. 13-15. When stitches overlap, it means that one stitch and another stitch pass through the same point. There are two cases when stitches overlap. The first case is when two stitches intersect with each other (endpoints of two line segments are not on one straight line), as shown in FIG. 13. The second case is when two stitches are oriented in the same direction (endpoints of two line segments are on one straight line), as shown in FIG. 14. As mentioned above, the coordinates of the needle drop point $p_n$ are stored in the coordinates array $R_n$ in advance and are expressed as (x-coordinate, y-coordinate)=($X_n$, $Y_n$).

When the two line segments (a first line segment and a second line segment) intersect with each other, as in the first case, the following two conditions are satisfied at the same time. The first condition is that a straight line which includes the first line segment should intersect with the second line segment. The second condition is that a straight line which includes the second line segment should intersect with the first line segment. For example, the first line segment is a line segment that goes through the determination processing (a line segment interconnecting the new needle drop point $p_n$ and the previous needle drop point $p_{n-1}$) and the second line segment is any one of the already formed line segments $p_0p_1$, $p_1p_2$, . . . , and $p_{n-2}p_{n-1}$.

For example, of the line segments shown in FIG. 13, the coordinate arrays are stored as $R_0$ (0, 0), $R_1$ (20, 0), $R_2$ (39.9, 1.7), $R_3$ (58, 10.2), $R_{13}$ (56.6, −4.2), and $R_{14}$ (42.5, 10).

Figure 15:
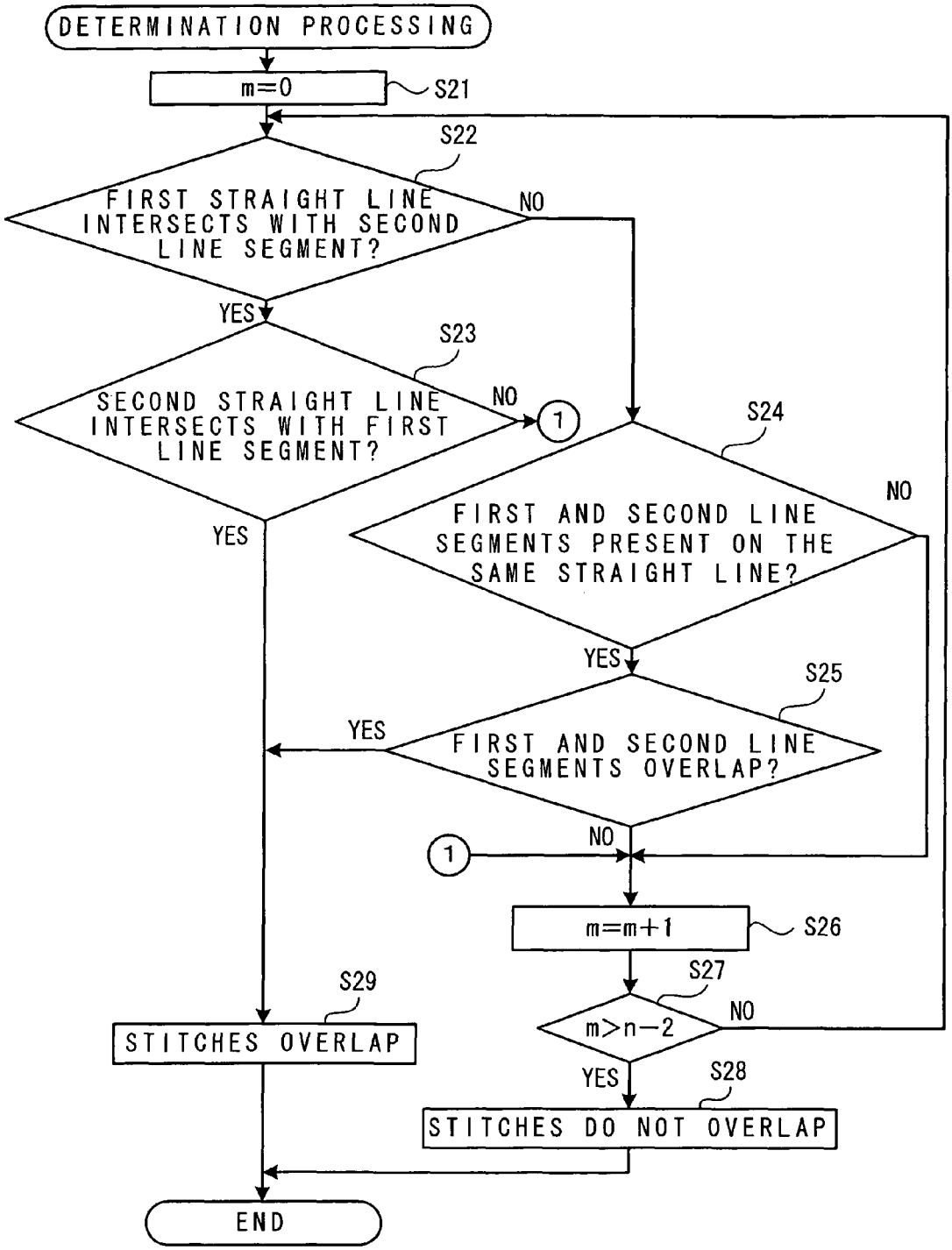
FIG. 15 is a flowchart of determination processing which is performed in the main processing of FIG. 12.

As shown in FIG. 15, in the determination processing, at step 21 (S21) the initial value 0 is stored as variable m used to specify the second line segment. Then, in step 22 (S22) a determination is made as to whether the first condition is satisfied, that is, whether a straight line that includes the first line segment $p_np_{n-1}$ intersects with the second line segment $p_mp_{m+1}$, i.e., line segment $p_0p_1$. The straight line that includes the first line segment $p_np_{n-1}$ is hereinafter referred to as a first straight line.

The equation for the first straight line can be expressed by $(X_{n-1}-X_n)(y-Y_{n-1})+(Y_{n-1}-Y_n)(-x+X_{n-1})=0$. Coordinates of two needle drop points that form the second line segment are respectively substituted into the left side $(X_{n-1}-X_n)(y-Y_{n-1})+(Y_{n-1}-Y_n)(-x+X_{n-1})$. A value obtained by substituting the coordinates of one of the two needle drop points that comes earlier in order is R1, and a value obtained by substituting the coordinates of the other needle drop point that comes later in order is R2. When the signs of those values are both negative, the two needle drop points that form the second line segment are present in a coordinate region below the first straight line. On the other hand, when the signs of those values are both positive, the two needle drop points that form the second line segment are present in a coordinate region above the first straight line. Therefore, if the sign of R1*R2 is negative, the first straight line extends between the two needle drop points that form the second line segment. In other words, the first straight line and the second line segment intersect with each other.

In the example shown-in FIG. 13, n=14. Therefore, R1 can be calculated by substituting coordinates $(X_0, Y_0)$ of point $p_0$ into x and y in $(X_{13}-X_{14})(y-Y_{13})+(Y_{13}-Y_{14})(-x+X_{13})$. R2 can also be calculated by substituting coordinates $(X_1, Y_1)$ of point $p_1$. Then, a determination is made as to whether the sign of R1*R2 is negative. In the example shown in FIG. 13, since the respective coordinates arrays are $R_0$ (0, 0), $R_1$ (20, 0), $R_{13}$ (56.6, −4.2), and $R_{14}$ (42.5, 10), R1=(56.6−42.5)(0−(−4.2))+(−4.2-10)(−0+56.6)=−744.5. Thus, the sign of R1 is negative. Further, R2=(56.6−42.5)(0−(−4.2))+(−4.2−10)(−20+56.6)=−460.5. Thus, the sign of R2 is also negative. Therefore, R1*R2 takes on a positive value, and thus it is determined that the first straight line and the second line segment do not intersect with each other (NO at S22). The process then advances to step 24 (S24).

At S24, a determination is made as to whether the first and second line segments are on the same straight line and overlap with each other, i.e., whether they are in the exemplary state shown in FIG. 14 (S24). If R1 and R2 used in the determination on an intersection at S22 are both 0, the first and second line segments are on the same straight line. Therefore, a determination is made as to whether R1=R2=0 (S24). If R1=R2=0 does not hold true (NO at S24), the first and second line segments are not on the same straight line. Therefore, the process advances to step 26 (S26), and 1 is added to variable m to make it 2, in order to specify the second line segment that goes through the determination processing next (S26). Then, in step 27 (S27) a determination is made as to whether the value of variable m is larger than n−2, i.e., whether the determination on intersection has been made on all the second line segments. In the example of FIG. 13, n−2=12 and m=2, so that it is determined that determination on an intersection has not yet been made on all the second line segments (NO at S27). The process then returns to S22.

If R1=R2=0, the first and second line segments are on the same straight line (YES at S24). Further, in step 25 (S25) a determination is made as to whether the two line segments overlap with each other. Specifically, a determination is made as to whether the x-coordinate $X_m$ of an endpoint $p_m$ of the second line segment $p_m p_{m+1}$ is present between the respective x-coordinates $X_n$ and $X_{n-1}$ of the endpoints $p_n$ and $p_{n-1}$ of the first line segment $p_n p_{n-1}$ (S25). More specifically, a determination is made as to whether $X_n \leqq X_m \leqq X_{n-1}$ or $X_{n-1} \leqq X_m \leqq X_n$. If $X_m$ is present between $X_n$ and $X_{n-1}$, the first and second line segments are on the-same straight line and overlap with each other (YES at S25). Therefore, in step 29 (S29) it is determined that the stitches overlap and the processing is ended.

On the other hand, if $X_m$ is not present between $X_n$ and $X_{n-1}$, the two line segments do not overlap with each other (NO at S25). Therefore, the process advances to step 26 (S26), and 1 is added to variable m to make it 2 in order to determine the next line segment (S26). Then at step 27 (S27) it is determined whether the determination of an intersection has been made on all the second line segments. If the determination has not been made on all of the second line segments (NO at S27), the process returns to S22 to determine whether the next second line segment intersects with the first straight line (S22). The processing of S22-S27 is then repeated.

In the example shown in FIG. 13, when variable m=2, it is determined at S22 that the second line segment intersects with the first straight line (YES at S22). In this case, the target for the determination is the second line segment $p_2p_3$. Since the respective coordinates arrays are $R_2$ (39.9, 1.7) and $R_3$ (58, 10.2), R1=(56.6−42.5)(1.7−(−4.2))+(−4.2−10)(−39.9+56.6)=−153.95. Thus, the sign of R1 is negative. Further, R2=(56.6−42.5)(10.2−(−4.2))+(−4.2−10)(−58+56.6)=222.92. Thus, the sign of R2 is positive. Therefore, R1*R2 takes on a negative value and it is thus determined that the second line segment intersects with the first straight line (YES at S22). In this case, the first condition is satisfied.

Next, it is determined whether the second condition is satisfied. Specifically, in step 23 (S23) a determination is made as to whether a straight line including the second line segment $p_m p_{m+1}$ intersects with the first line segment $p_n p_{n-1}$. The straight line including the second line segment $p_m p_{m+1}$ is hereinafter referred to as a second straight line.

Like the first straight line, an equation for the second straight line can be expressed as $(X_{m+1}-X_m)(y-Y_{m+1})+(Y_{m+1}-Y_m)(-x+X_{m+1})=0$. The coordinates of two needle drop points $p_n$ and $p_{n-1}$ that form the first line segment $p_n p_{n-1}$ are substituted into the left side $(X_m+1-X_m)(y-Y_{m+1})+(Y_{m+1}-Y_m)(-x+X_{m+1})$. A value obtained by substituting the coordinates of the needle drop point $p_{n-1}$ is R3, and a value obtained by substituting the coordinates of the needle drop point $p_n$ is R4. When the signs of those values are both negative, the two needle drop points that form the first line segment are present in a coordinate region below the second straight line. On the other hand, when the signs of those values are both positive, the two needle drop points are present in a coordinate region above the second straight line. Therefore, if the sign of R3*R4 is negative, the second straight line extends between the two needle drop points that form the first line segment, i.e., the second straight line and the first line segment intersect with each other.

In the example shown in FIG. 13, since R3=(39.9)(−4.2−1.7)+(1.7−10.2)(−56.6−39.9)=248.74, the sign of R3 is positive. Further, since R4=(39.9)(10−1.7)+(1.7−10.2)(−42.5−39.9)=−128.13, the sign of R4 is negative. Therefore, R3*R4 takes on a negative value, and it is determined that the second straight line intersects with the first line segment (YES at S23). In other words, the second condition also is satisfied. Accordingly, in step 29 (S29) it is determined that the stitches overlap.

If having determined that the first line segment and the second straight line do not intersect with each other (NO at S23), the process advances to S26, and 1 is added to variable m to make it 2 in order to make determination on the next second line segment (S26). Then, determination is made as to whether the determination on intersection has been made on all the second line segments (S27). If determination has not yet been made on all of the second line segments (NO at S27), the process returns to S22 to determine whether the next second line segment intersects with the first straight line (S22).

If none of the second line segments pmpm+1 intersects with the first straight line and, further, they are not on the same straight line (NO at S22 and NO at S24, NO at S22, YES at S24, NO at S25, and YES at S27), in step 28 (S28) it is determined that the stitches do not overlap. If it is determined that the second line segment $p_m p_{m+1}$ and the first straight line intersect with each other but there is no second line segment $p_m p_{m+1}$ to make the second straight line which intersects with the first line segment $p_n p_{n-1}$ (YES at S22, NO at S23 and YES at S27), it is also determined that the stitches do not overlap (S28).

Figure 12:
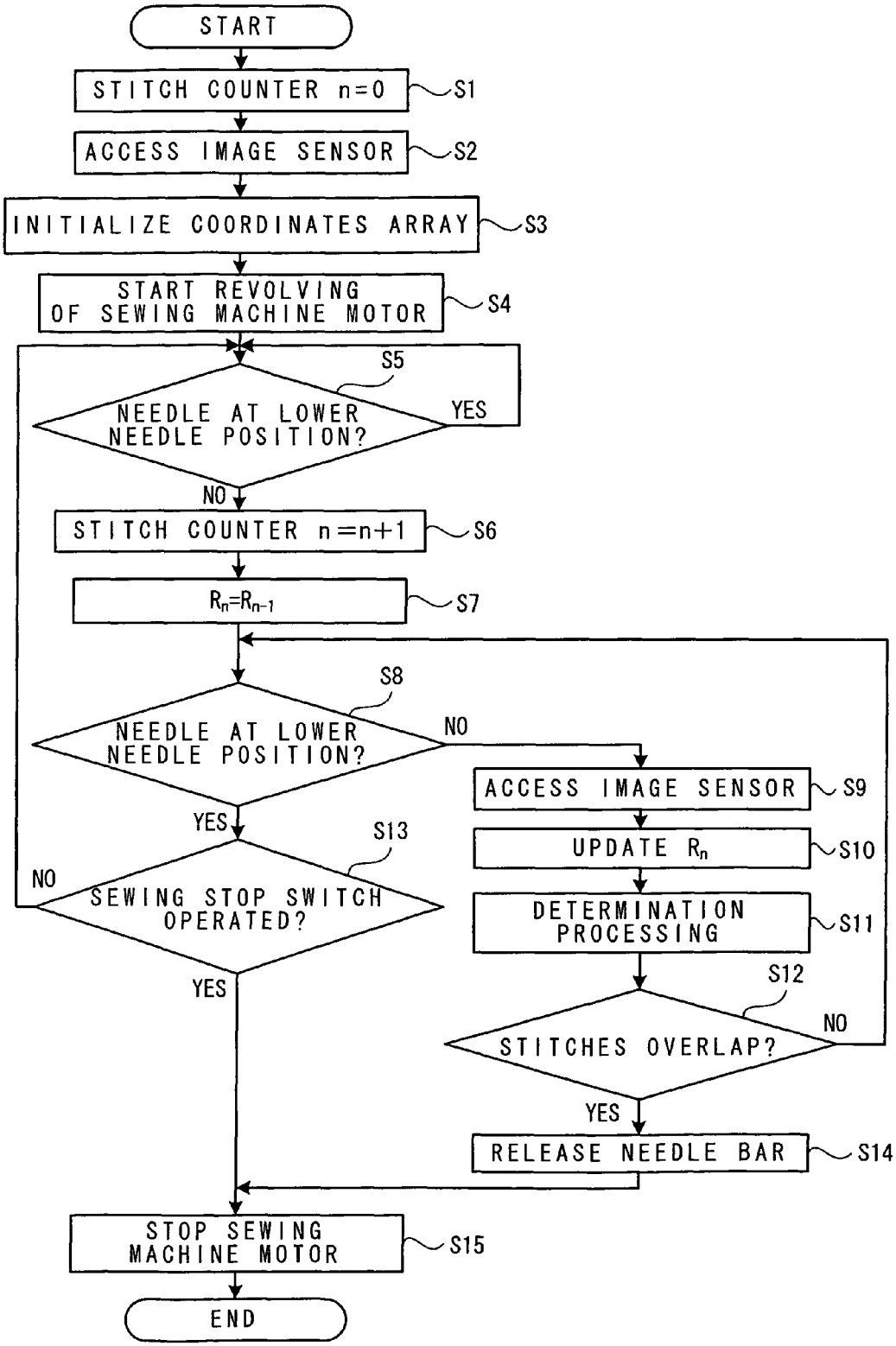
FIG. 12 is a flowchart of main processing showing the operations of the sewing machine.

In such a manner, in the determination processing at S11 (FIG. 15) in the main processing shown in FIG. 12, the coordinates array R stored in the coordinate storage area 632 is referenced, and it is determined whether a stitch to be formed by interconnecting a point indicated by $R_{n-1}$ and a point where the sewing needle 7 is to be pierced into the work cloth at this point in time overlaps with any one of stitches formed so far.

As described above, in the sewing machine 1 of the first embodiment, the coordinates of the needle drop points are stored beforehand in the coordinates array R. Then, while the sewing needle 7 is not at the lower needle position, continual monitoring is made as to whether stitches overlap. More specifically, it is continually monitored to determine whether a line segment interconnects a position at which the sewing needle 7 is to be lowered from the current position and a position at which the sewing needle 7 is most recently pulled out from the work cloth (most recent needle drop point), that is, whether the line segment $p_n p_{n-1}$, overlaps with any one of the line segments that indicate stitches formed so far (line segments $p_0p_1$, $p_1p_2$, . . . , and $p_{n-2}p_{n-1}$). If it is determined that the line segments overlap with each other, the needle bar releasing mechanism 25 releases the needle bar 6 from power due to the driving of the sewing machine motor 79, thereby operations of the sewing needle 7 are stopped.

Therefore, the stitches can be prevented from overlapping with each other. It is thus possible to avoid making a mistake of overlapping stitches when, for example, a stippling stitch is formed by free-motion sewing, for which overlapping stitches may be considered unattractive.

The sewing machine 1 in the above-described embodiment may be modified as follows. For example, in the first embodiment, a CCD camera is employed in the image sensor 50. The image sensor 50, however, only needs to be capable of detecting a movement distance and a movement direction of a work cloth. Optionally, the camera may be a CMOS camera.

In the above-described embodiment, a determination is made as to whether a stitch to be formed, which interconnects a point indicated by $R_{n-1}$ and a point at which the sewing needle 7 is to be pierced into the work cloth from the current position, overlaps with any one of the stitches formed so far. Based on the determination, the stitches can be prevented from overlapping with each other (S11 in FIG. 12). However, this determination may not include whether the stitches (line segments) overlap with each other. For example, it may be determined whether there is any stitch (line segment) among the stitches (line segments) formed so far that has a predetermined range within which the coordinates position $p_n$ of the sewing needle 7 is present. In this case, if a stitch already exists in the predetermined range when the sewing needle 7 is pierced into the work cloth, i.e., if a stitch exists in the vicinity of the needle drop point $p_n$, the error correction operation (releasing of the needle bar 6) may be performed.

Figure 16:
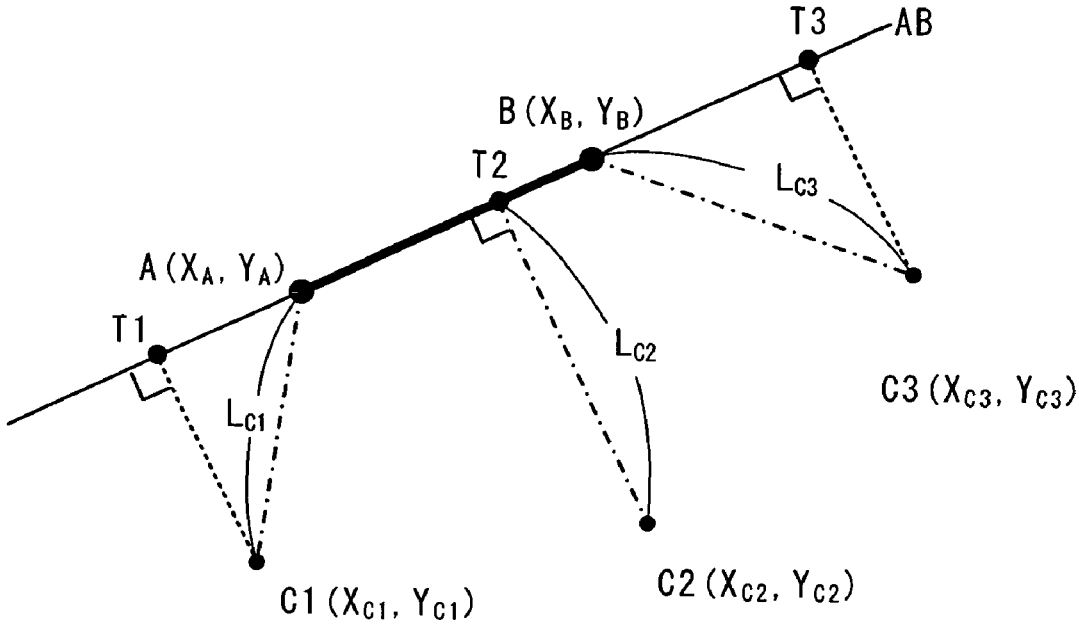
FIG. 16 is an explanatory illustration of a method of calculating a distance between a line segment (stitches) and a point (needle drop point)

One example of the determination on whether there is a stitch in the predetermined range is described below with reference to FIG. 16. In this example, a distance between line segment AB and point C, which is not present on line segment AB, as shown in FIG. 16, is considered. A distance between point C and one of the points on line segment AB that is nearest to point C is taken as distance L. The relationships between line segment AB and point C are divided into three cases shown in FIG. 16. In the first case, the intersection point T of line segment AB and a perpendicular line drawn from point C to straight line AB is on line segment AB (point C2 and intersection point T2). In the second case, intersection point T is not present on line segment AB, and is closer to point A than to point B (point C1 and intersection T1). In the third case, intersection point T is not present on line segment AB, and is closer to point B than to point A (point C3 and intersection T3).

As shown in FIG. 16, in the first case where intersection point T2 is on line segment AB, length $L_{C2}$ of a perpendicular line drawn from point C2 to straight line AB is taken as distance L between line segment AB and point C. In the second case where intersection point T1 is not on line segment AB and is closer to point A, which is one of the endpoints of line segment AB, length $L_{C1}$ of line segment $A_{C1}$ interconnecting point C1 and point A is taken as distance L between line segment AB and point C. In the third case where intersection point T3 is not on line segment AB and closer to point B, which is the other endpoint of line segment AB, length $L_{C3}$ of line segment $B_{C3}$ interconnecting point C3 and point B is taken as distance L between line segment AB and point C.

In the determination process, the position of intersection point T is first determined. An amount of change in x and an amount of change in y along line segment AB can be defined as $dx=X_B-X_A$ and $dy=Y_B-Y_A$, respectively. Then, the coordinates of intersection T of straight line AB and the perpendicular line drawn from point C to straight line AB can be expressed as $T(X_A+dx*t, Y_A+dy*t)$. In this case, if $0 \leqq t \leqq 1$, intersection point T is present on line segment AB. If $t<0$, intersection T is present outside of point A of line segment AB along straight line AB. If $1<t$, intersection T is present outside of point B of line segment AB along straight line AB.

Variable t can be obtained as follows. Since line segment TC and line segment AB are perpendicular to each other, the inner product of their vectors is 0. That is, $(dx, dy)\cdot(X_A+dx*t-X_C, Y_A+dy*t-Y_C)=0$ is established. This equation may be rearranged as $(dx^2+dy^2)t+dx(X_A-X_C)+dy(Y_A-Y_C)=0$. Supposing that $dx^2+dy^2=a$ and $dx(X_A-Y_C)+dy(Y_A-Y_C)=b$, the equations can be expressed as $a*t+b=0$, and $t=-b/a$ can be obtained. The values of a and b are expressed by the coordinates of point A, B, and C and as such, can be calculated, referring to the coordinates of array R.

If $t<0$, point C has a position relationship of point C1 shown in FIG. 16. Accordingly, distance L between line segment AB and point C is distance $L_{C1}$ between point A and point C1. Specifically, distance $L_{C1}$ is a positive square root of $(X_A-X_C)^2+(Y_A-X_{C1})^2$. Further, if $t>0$, point C has a position relationship of point C3 shown in FIG. 16. Accordingly, distance L between line segment AB and point C is distance $L_{C3}$ between point B and point C3. Specifically, distance $L_{C3}$ is a positive square root of $(X_B-X_{C3})^2+(Y_B-Y_{C3})^2$.

Further, if $0 \leqq t \leqq 1$, point C has a position relationship of point C2 shown in FIG. 16. Supposing that intersection point T2 is at $(X_{T2}, Y_{T2})$, distance $L_{C2}$ is a positive square root of $(X_A-X_{T2})^2+(Y_A-Y_{T2})^2$. It should be noted that $X_{T2}=X_A+dx*t=X_A+dx*(-b/a)$ and $Y_{T2}=Y_A+dy*t=Y_A+dy*(-b/a)$. The values of a and b are expressed by the coordinates of point A, B, and C, and as such, can be calculated referencing the coordinates array R.

Thus, calculated distance L is compared with a preset reference distance. If distance L is not larger than the reference distance, it is determined that there is already a stitch in a predetermined range so the needle bar releasing processing is performed. As the reference distance, a predetermined value (e.g., 3 mm etc.) may be stored in advance. Further, the reference distance may be determined in accordance with a stitch length (pitch). For example, the reference distance may be the same as the stitch length, 1.5 times as long as the stitch length, or longer than the stitch length by 2mm. The reference distance may be stored in the ROM 62 or the EEPROM 64 or written into the program. Further, a menu for setting a reference distance may be displayed on the LCD 10 so that the user can enter a numeral on the touch panel 16 or select one of several preset numerals. If the user is permitted to set the reference distance, the user can employ a desired distance. Therefore, the user can adjust the numeral by, for example, selecting a small value if stitch trajectories come close to each other, and may select a large value if stitch trajectories do not come close to each other.

Further, rather than determining whether there is any one such stitch among the stitches formed thus far where the coordinates position $p_n$ of the sewing needle 7 is present in the predetermined range, determination may be made as to whether the last needle drop point (coordinates position $p_{n-1}$) is in the predetermined range.

Further, in the first embodiment, if stitches are expected to overlap with each other, the needle bar releasing mechanism 25 releases the needle bar 6 from driving power of the sewing machine motor 79 as an error correction operation, thereby stopping the operations of the sewing needle 7. However, the error correction operation is not limited to releasing the needle bar 6. For example, revolving of the sewing machine motor 79 may be stopped to stop the operations of the sewing needle 7. In this case, even after the revolving of the sewing machine motor 79 is stopped, several stitches may be formed through inertia. Nevertheless, the sewing machine motor 79 will be stopped faster than in a case where the user operates the sewing stop switch 82 after the user finds a stitch overlap. Therefore, even if stitches overlap with each other, the number of the overlapping stitches may be reduced. Further, rather than stopping the revolving of the sewing machine motor 79, the sewing machine motor 79 may be slowed down, i.e., the sewing speed may be decreased.

Figure 17:
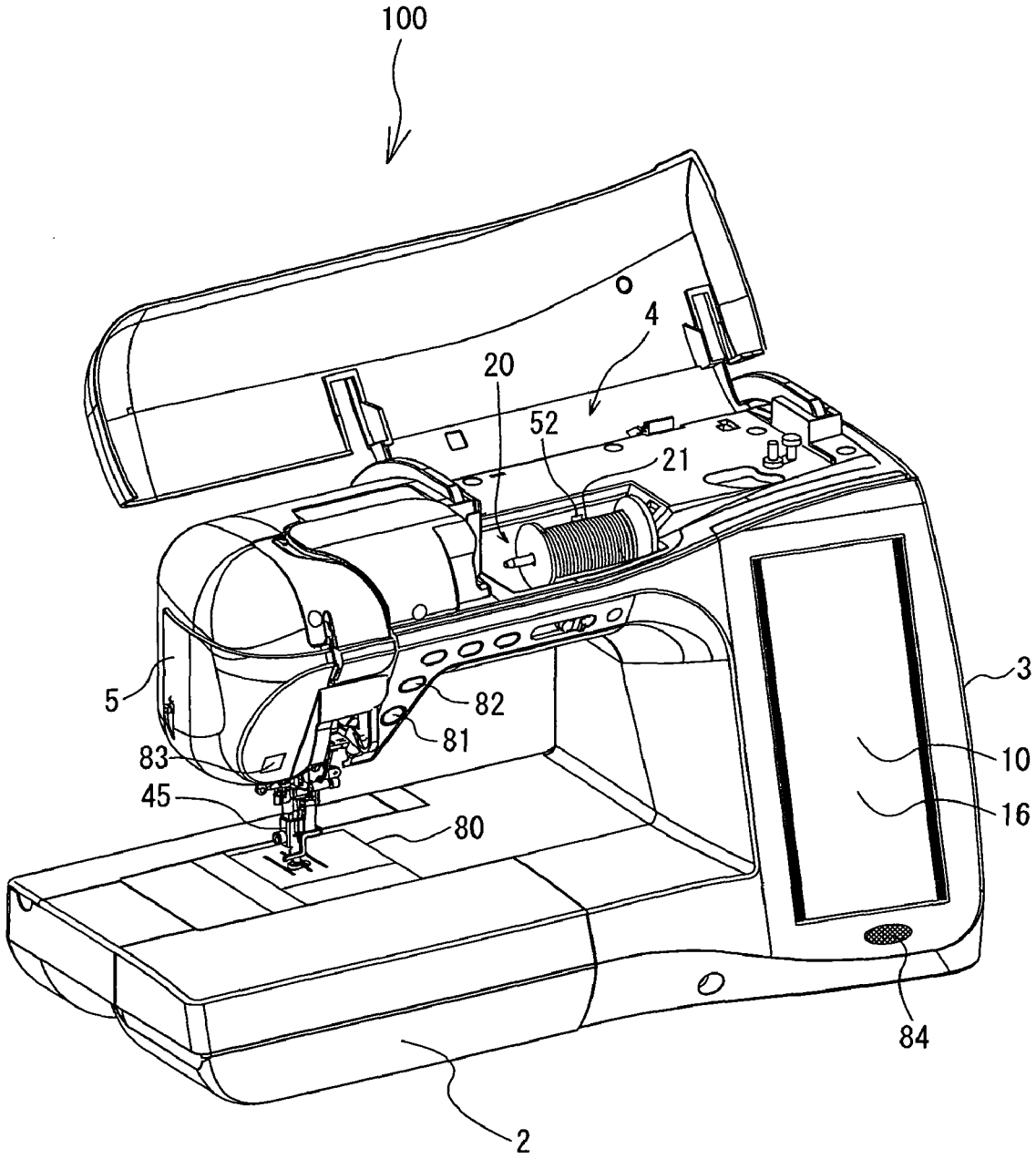
FIG. 17 is an overall perspective view of the sewing machine according to a modification of the first embodiment.
Figure 18:
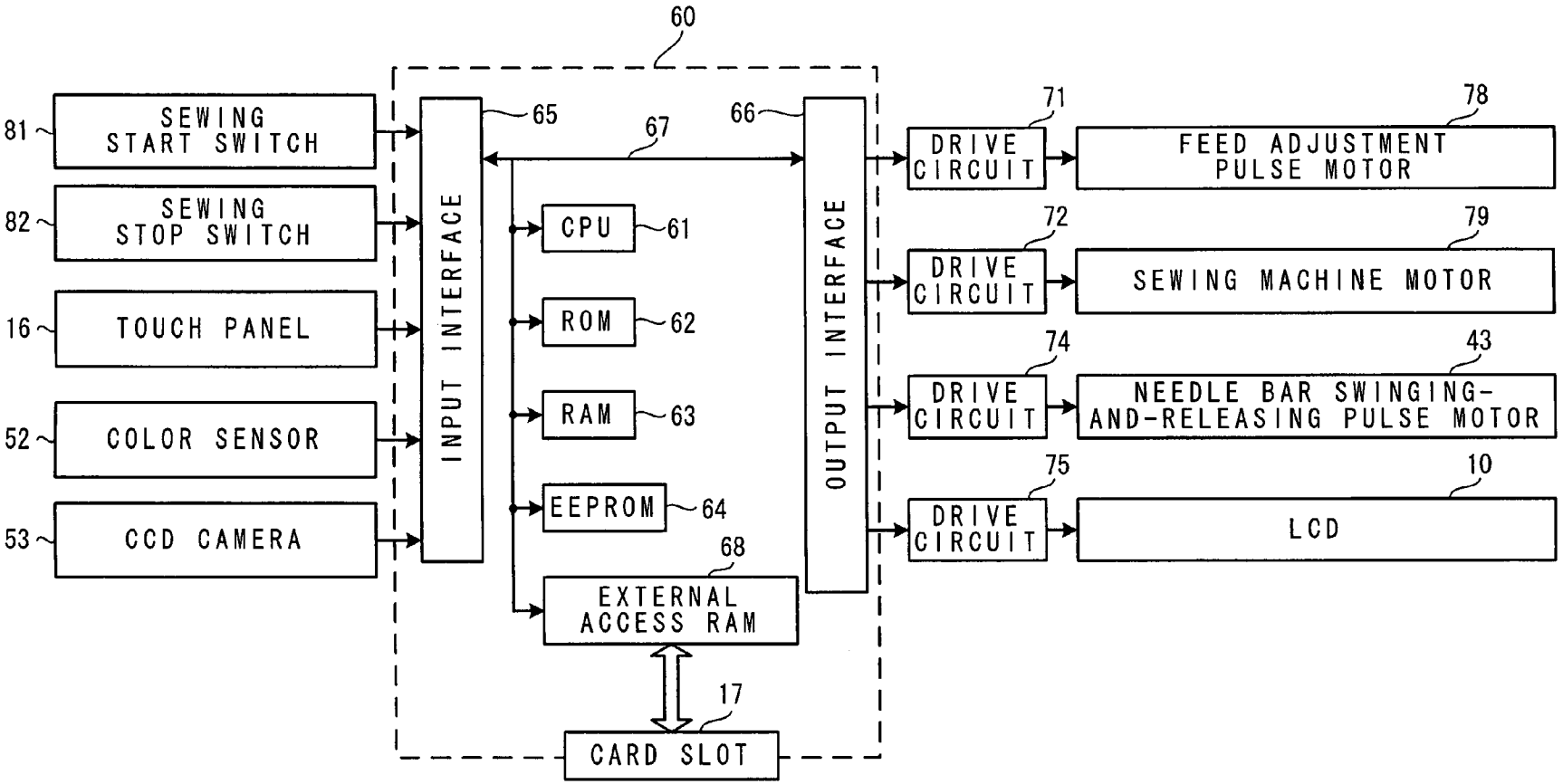
FIG. 18 is a block diagram showing the electrical configuration of the sewing machine according to a second embodiment.

Further, the error correction operation may involve notification rather than stopping or slowing down the operations of the sewing needle 7. As shown in FIG. 17, an alarm lamp 83 may be provided to the sewing machine 100, so that it would light up or blink if stitches are expected to overlap with each other. The alarm lamp 83 might be disposed in the vicinity of a position at which the sewing needle 7 is stuck into a work cloth (needle drop point). For example, the alarm lamp 83 may be disposed at the lower end portion of the front surface of the head 4, as shown in FIG. 17. The alarm lamp 83 may be connected to the output interface 66 so that it may light up in accordance with an instruction from the CPU 6 1. Further, as shown in FIG. 17, a speaker 84 may be fitted to the sewing machine 100 so as to produce an alarm sound or a reminder message. The speaker 84 may also be connected to the output interface 66. Further, these notification operations may be combined with other error correction operations, such as stopping of the operations of the sewing needle 7, slowing down of the sewing speed, or releasing of the needle bar 6.

Next, a second embodiment will be described below with reference to FIGS. 17-21. In the second embodiment, a sewing machine 100 includes a CCD camera 53, which captures an image in the vicinity of a needle drop point. If there is a stitch in the image captured, it is determined that a stitch is already present near an expected sewing position, and so there is a possibility of stitch overlapping. In this case, a sewing machine motor 79 is stopped to stop the operations of a sewing needle 7 so that sewing is stopped. The physical configuration of the sewing machine 100 in the second embodiment is much the same as that of the sewing machine 1 in the first embodiment, and so the explanation is omitted here. In the first embodiment, the sewing machine 1 includes the image sensor 50 (see FIG: 8). In the second embodiment, as shown in FIG. 17, the sewing machine 100 further includes a color sensor 52 that detects a thread color. The color sensor 52 is fitted into the spool housing 20, to which a thread spool 21 used in sewing is attached.

Next, the electrical configuration of the sewing machine 100 is described below. The electrical configuration of the sewing machine 100 also is much the same as that of the sewing machine 1 in the first embodiment (see FIG. 9). In the sewing machine 1, the CCD camera 53 is connected to the input interface 65. In the sewing machine 100, the color sensor 52 is also connected to the input interface 65. The CCD camera 53 and the color sensor 52 capture images as required by the CPU 61, and input thread color data detected from the captured image to the input interface 65.

Figure 19:
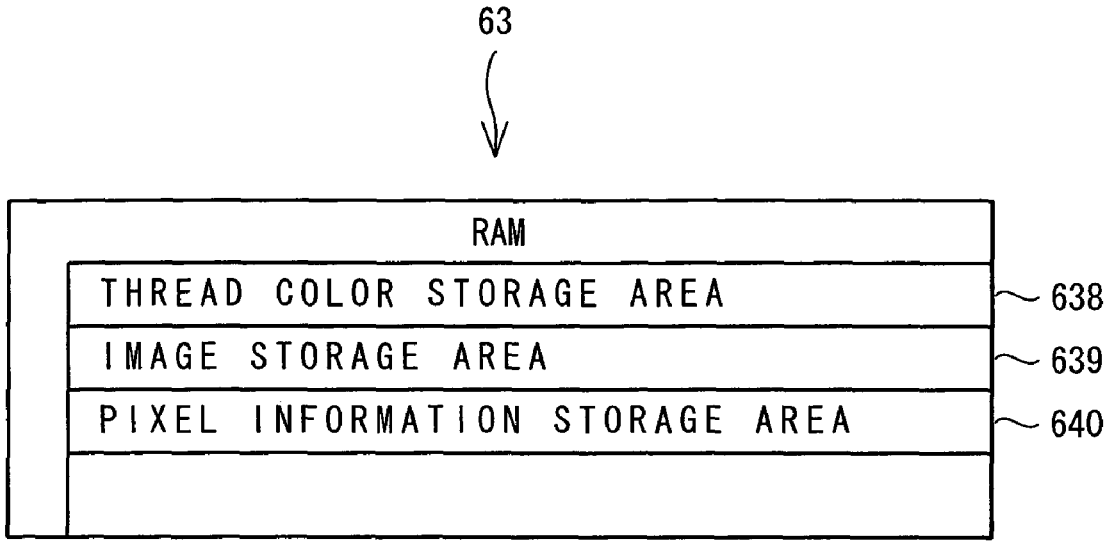
FIG. 19 is a conceptual diagram showing the configuration of the RAM according to the second embodiment.

Now, storage areas provided in a RAM 63 are described below with reference to FIG. 19. As shown in FIG. 19, the RAM 63 has a thread color storage area 638, an image storage area 639, and a pixel information storage area 640. The RAM 63 has other storage areas other than those shown in FIG. 19. The thread color storage area 638 stores data of a thread color detected by the color sensor 52. The image storage area 639 stores an image of a work cloth (hereinafter referred to as a work cloth image) taken by the CCD camera 53. The pixel information storage area 640 stores information that indicates a pixel that is determined to have the same color as the thread color in the most recent two work cloth images (a current image and a last image). The information indicating the pixel is hereinafter referred to as stitch pixel information.

Figure 20:
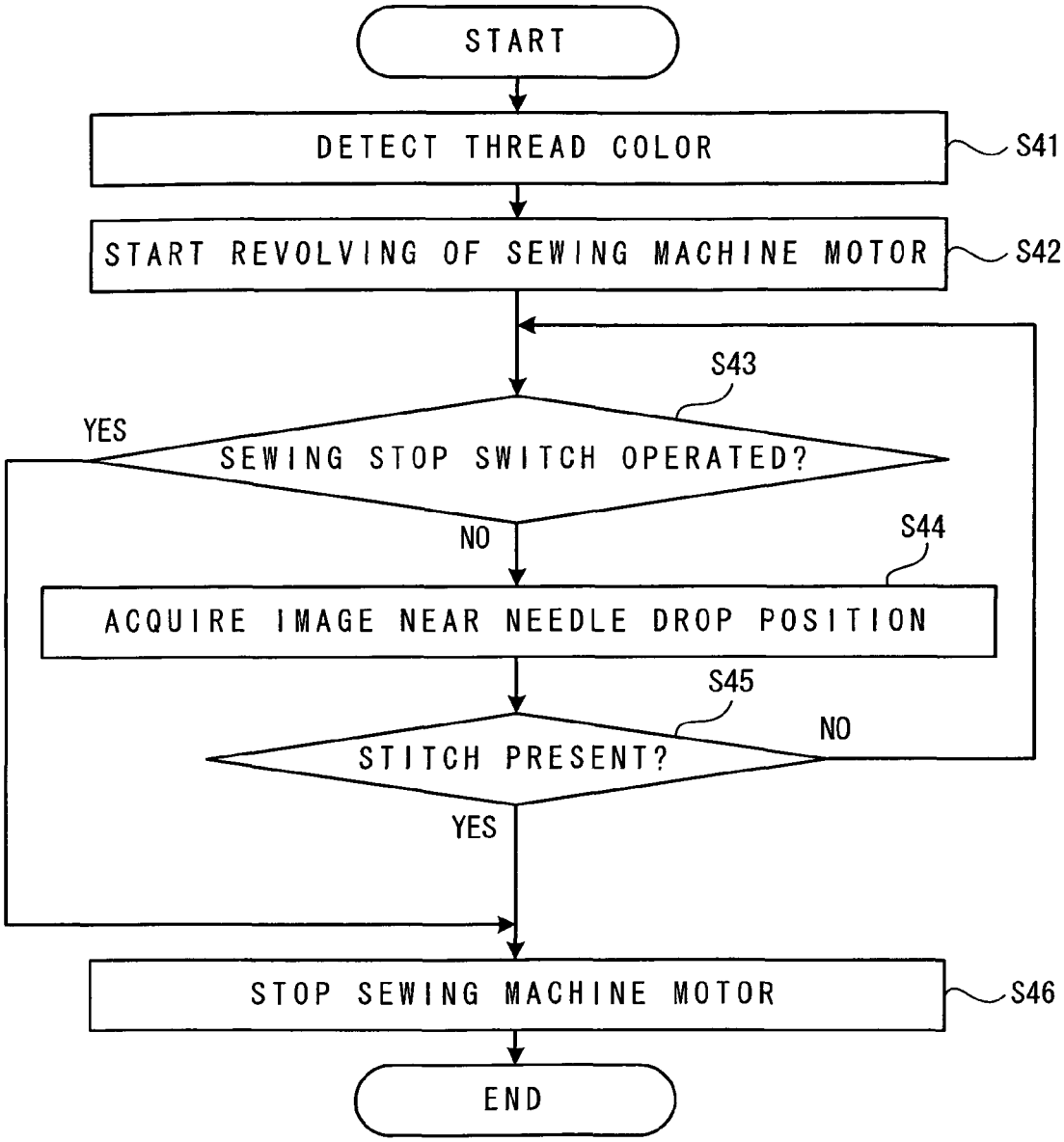
FIG. 20 is a flowchart showing the operations of the sewing machine according to the second embodiment.
Figure 21:
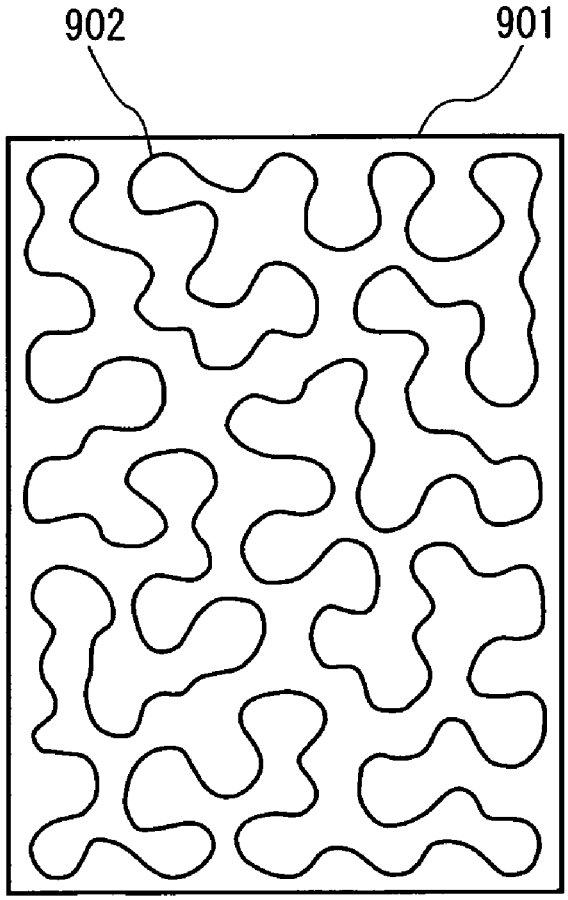
FIG. 21 is an explanatory illustration showing one example of a shape of stitches formed by stippling stitching.

Next, the operations of the sewing machine 100 are described below with reference to FIG. 20. Processing shown in FIG. 20 starts when a sewing start switch 81 is operated to instruct start-up of sewing. As shown in FIG. 20, in step 41 (S41) a thread color is detected (S41). Specifically, data of the thread color detected by the color sensor 52 is stored as RGB-values in the thread color storage area 638.

Subsequently, in step 42 (S42) a sewing machine motor 79 starts revolving to begin sewing. Then, in step 43 (S43) a determination is made as to whether a sewing stop switch 82 is operated. If the sewing stop switch 82 is not operated (NO at S43), in step 44 (S44) an image of the vicinity of the needle drop point is captured by the CCD camera 53, and a work cloth image is stored in the image storage area 639. Then, in step 45 (S45) a determination is made as to whether there is a stitch in the work cloth image.

Specifically, the last stitch pixel information stored in the pixel information storage area 640 is updated by the current stitch pixel information. Then, RGB-values of each of the pixels of the work cloth image are compared with the RGB-values of the thread color stored in the thread color storage area 638. If the respective RGB-values are in a predetermined allowable range, they are considered to agree with each other. For example, if the R-value of the thread color is 125 and the R-value of the pixel in the work cloth image is in the range of ±3, that is, between 122 and 128, it is determined that their respective R-values agree with each other. In such a manner, information that indicates that the pixels whose RGB-values are all determined to agree with those of the thread color is stored as the current stitch pixel information in the pixel information storage area 640 in the RAM 63. If there are at least a predetermined number of the pixels that are stored in the pixel information storage area 640 as the number of those that agree with the thread color in RGB-values, it is determined that there is a stitch in the work cloth image. The predetermined number may be either a constant percentage (1%, 0.5%, etc.) of all the pixels in a work cloth image or a fixed value. The fixed value, if employed, may vary with the resolution of a work cloth image.

Even if there is a stitch, there is no problem if the stitch has been formed most recently. That is, if the work cloth image has at least the predetermined number of pixels having the same color as the thread color, determination is made as to whether the stitch has been formed most recently. This determination is made by comparing the last stitch pixel information and the current stitch pixel information with each other. If a ratio at which the pixels indicated by the last stitch pixel information and the pixels indicated by the current stitch pixel information agree in at least a predetermined percentage, it may be considered that images of the same stitch have been captured. Accordingly, the percentage at which the pixels agree is calculated and, if it is at least a predetermined value (e.g., 50%), the stitch that is present in the work cloth image has been formed most recently. In such a case, it is determined that there is no stitch in the work cloth image.

If it is determined at S45 that there is a stitch in the work cloth image-(YES at S45), the revolving of the sewing machine motor 79 is stopped to stop the operations of the sewing needle 7, and sewing is stopped at step 46 (S46). Then, the present processing is ended. If it is determined at S45 that there is no stitch (NO at S45), the process returns to S43 and the processing of S43-S45 is repeated. If the sewing stop switch 82 is operated during the processing (YES at S43), the present processing is ended.

As described above, in the sewing machine 100 in the second embodiment, if a stitch exists in the vicinity of a needle drop point, revolving of the sewing machine motor 79 is stopped in the error correction operation. Even after the revolving of the sewing machine motor 79 is stopped, several stitches may be formed because the operations of the needle bar 6 do not stop immediately. Nevertheless, the sewing machine motor 79 will be stopped faster than in a case where the user operates the sewing stop switch 82 after the user finds a stitch overlap. Therefore, even if stitches overlap with each other, the number of the overlapping stitches may be reduced so that fewer stitches may need to be unraveled, thereby mitigating the job of unraveling by the user.

The sewing machine 100 in the second embodiment may be modified as follows. For example, in the second embodiment, the sewing machine motor 79 is stopped to stop sewing in an error correction operation. However, the error correction operation is not limited to stopping the sewing machine motor 79. As in the first embodiment, the operations of the sewing needle 7 may be stopped by releasing the sewing needle 6 from driving power of the sewing machine motor 79 by using the needle bar releasing mechanism 25. Other error correction operations such as those described in the first embodiment also may be employed.

In the present embodiment, a determination is made as to whether there is a stitch in a predetermined range of a work cloth. It may be determined whether the stitch overlaps with any one of already formed stitches. In this case, if a line segment interconnecting an ending point of a most-recently formed stitch and a needle drop point overlaps with a detected stitch, it may be determined that the stitches overlap.

In the second embodiment, the color sensor 52 is attached to the spool housing 20. The attachment position, however, is not limited to this configuration. The attachment position may be anywhere, as long as it is possible to detect a thread set along a thread hooking path from the thread spool 21 to the sewing needle 7. Further, instead of detecting a thread color by the color sensor 52, the RGB-values of the thread colors of a plurality of thread kinds may be stored in advance in the EEPROM 64 or the ROM 62 in the sewing machine 100. In such a case, the thread colors may be displayed on the LCD 10 and selected by the user via the touch panel 16. When the LCD 10 is not colored, the color names and the thread part numbers may be displayed so that the user can select a desired thread color.

Further, in the second embodiment, a stitch is detected on the assumption that the entirety of a work cloth image taken by the CCD camera 53 is within a predetermined range. However, the predetermined range may not be the entirety of the work cloth image, but may be only a part of the work cloth. For example, it is possible to use only such part of an image taken by the CCD camera 53 as necessary to be in a needle traveling direction from a needle drop point. In such a case, the most-recently formed stitch will not be detected. Further, in the second embodiment, images are continually taken by the CCD camera 53 to determine whether there is a stitch. However, there cannot be an already formed stitch when sewing is started, so that the CCD camera may be set to capture nothing within a predetermined lapse of time after the startup of sewing. Further, rather than taking images continually, the images may be taken at every predetermined lapse of time (e.g., 0.2s) to determine whether there is a stitch. Further, the CCD camera 53 may be replaced by a CMOS camera.

What is claimed is:

1. A sewing machine that sews a work cloth being moved by a user, the sewing machine comprising:

a detection device that detects the work cloth;

a movement calculation device that calculates a direction and a distance of movement of the work cloth as movement data when the work cloth is detected by the detection device, the movement being determined based on a location where the work cloth was previously detected by the detection device, and the movement data being in the form of two-dimensional coordinate data;

a movement data storage device that stores the movement data calculated by the movement calculation device;

a movement data creation device that causes the detection device to detect the work cloth for each stitch formed in sewing the work cloth, thereby causing the movement calculation device to calculate the movement data, and that stores the movement data calculated by the movement calculation device into the movement data storage device;

a line segment specification device that specifies a line segment as a specified line segment based on the movement data stored in the movement data storage device;

a determination device that determines whether a stitch to be formed next will overlap with an already formed stitch when the work cloth is detected by the detection device in a state where a sewing needle is above the work cloth, based on whether a line segment interconnecting a first position and a second position overlaps with the specified line segment or whether the specified line segment exists within a predetermined distance from the first position or the second position, the first position being a position on the work cloth below the sewing needle, and the second position being a most recent needle drop position; and an error control device that performs an error correction operation if it is determined by the determination device that the stitch to be formed next will overlap with the already formed stitch.

2. The sewing machine according to claim 1, further comprising a predetermined distance setting device that sets the predetermined distance.

3. The sewing machine according to claim 1, wherein the error correction operation performed by the error control device is an operation to stop a sewing machine motor operating the sewing needle or is an operation to slow down a revolving speed of the sewing machine motor.

4. The sewing machine according to claim 1, further comprising a needle releasing mechanism that releases the sewing needle from power that is transmitted from a sewing machine motor operating the sewing needle, wherein the error correction operation performed by the error control device is an operation to release the sewing needle from the power transmitted from the sewing machine motor by the needle bar releasing mechanism.

5. The sewing machine according to claim 1, further comprising a notification device that notifies the user with an alarm, wherein the error correction operation performed by the error control device is a notification operation by the notification device.

6. The sewing machine according to claim 1, wherein the detection device detects the work cloth based on an image taken by a CCD image sensor or a CMOS image sensor.

7. A sewing machine that sews a work cloth being moved by a user, the sewing machine comprising:

a detection device that detects a stitch formed on the work cloth;

a determination device that determines whether a stitch to be formed next will overlap with an already formed stitch, based on whether the stitch detected by the detection device exists within a predetermined range determined on the basis of a first position or whether a line segment interconnecting the first position and a second position overlaps with the stitch detected by the detection device, the first position being a position on the work cloth below a sewing needle when the stitch is detected by the detection device in a state where the sewing needle is above the work cloth, the second position being a most recent needle drop position; and an error control device that performs an error correction operation if it is determined by the determination device that the stitch to be formed next will overlap with the already formed stitch.

8. The sewing machine according to claim 7, further comprising a predetermined range setting device that sets the predetermined range.

9. The sewing machine according to claim 7, wherein the error correction operation performed by the error control device is an operation to stop a sewing machine motor operating the sewing needle or is an operation to slow down a revolving speed of the sewing machine motor.

10. The sewing machine according to claim 7, further comprising a needle releasing mechanism that releases the sewing needle from power that is transmitted from a sewing machine motor operating the sewing needle, wherein the error correction operation performed by the error control device is an operation to release the sewing needle from the power transmitted from the sewing machine motor by the needle bar releasing mechanism.

11. The sewing machine according to claim 7, further comprising a notification device that notifies the user with an alarm, wherein the error correction operation performed by the error control device is a notification operation by the notification device.

12. The sewing machine according to claim 7, wherein the detection device detects the first position and the stitch formed on the work cloth based on an image taken by a CCD image sensor or a CMOS image sensor.

13. A non-transitory computer-readable recording medium storing a sewing machine control program for a sewing machine that sews a work cloth being moved by a user, the program comprising:

instructions for detecting the work cloth;

instructions for calculating a direction and a distance of movement of the work cloth as calculated movement data each time the work cloth is detected, the movement being determined based on a location where the work cloth was previously detected, and the movement data being in the form of two-dimensional coordinate data;

instructions for storing the calculated movement data as stored movement data each time the movement data is calculated;

instructions for specifying a line segment as a specified line segment based on the stored movement data;

instructions for determining whether a stitch to be formed next will overlap with an already formed stitch when the work cloth is detected in a state where a sewing needle is above the work cloth, based on whether a line segment interconnecting a first position and a second position overlaps with the specified line segment or whether the specified line segment exists within a predetermined distance from the first position or the second position, the first position being a position on the work cloth below the sewing needle, and the second position being a most recent needle drop position; and instructions for performing an error correction operation if it is determined that the stitch that is to be formed next will overlap with the already formed stitch.

14. The non-transitory computer-readable recording medium according to claim 13, the program further comprising instructions for setting the predetermined distance.

15. The non-transitory computer-readable recording medium according to claim 13, wherein the error correction operation is an operation to stop a sewing machine motor operating the sewing needle or is an operation to slow down a revolving speed of the sewing machine motor.

16. The non-transitory computer-readable recording medium according to claim 13, the program further comprising instructions for releasing the sewing needle from power that is transmitted from a sewing machine motor operating the sewing needle, wherein the error correction operation is an operation to release the sewing needle from the power transmitted from the sewing machine motor.

17. The non-transitory computer-readable recording medium according to claim 13, the program further comprising instructions for notifying the user with an alarm, wherein the error correction operation is a notification operation.

18. A non-transitory computer-readable recording medium storing a sewing machine control program for a sewing machine that sews a work cloth being moved by a user, the program comprising:

instructions for detecting a stitch formed on the work cloth;

instructions for determining whether a stitch to be formed next will overlap with an already formed stitch, based on whether the detected stitch exists within a predetermined range determined on the basis of a first position or whether a line segment interconnecting the first position and a second position overlaps with the detected stitch, the first position being a position on the work cloth below a sewing needle when the stitch is detected in a state where the sewing needle is above the work cloth, the second position being a most recent needle drop position; and instructions for performing an error correction operation if it is determined that the stitch to be formed next will overlap with the already formed stitch.

19. The non-transitory computer-readable recording medium according to claim 18, the program further comprising instructions for setting the predetermined range.

20. The non-transitory computer-readable recording medium according to claim 18, wherein the error correction operation is an operation to stop a sewing machine motor operating the sewing needle or is an operation to slow down a revolving speed of the sewing machine motor.

21. The non-transitory computer-readable recording medium according to claim 18, the program further comprising instructions for releasing the sewing needle from power that is transmitted from a sewing machine motor operating the sewing needle, wherein the error correction operation is an operation to release the sewing needle from the power transmitted from the sewing machine motor.

22. The non-transitory computer-readable recording medium according to claim 18, the program further comprising instructions for notifying the user with an alarm, wherein the error correction operation is a notification operation.

* * * * *